US007663576B2

(12) United States Patent
Ozaki

(10) Patent No.: US 7,663,576 B2
(45) Date of Patent: Feb. 16, 2010

(54) VIDEO DATA CORRECTION CIRCUIT, CONTROL CIRCUIT OF DISPLAY DEVICE, AND DISPLAY DEVICE AND ELECTRONIC APPARATUS INCORPORATING THE SAME

(75) Inventor: Tadafumi Ozaki, Kanagawa (JP)

(73) Assignee: Semiconductor Energy Laboratory Co., Ltd., Atsugi-shi, Kanagawa-Ken (JP)

( * ) Notice: Subject to any disclaimer, the term of this patent is extended or adjusted under 35 U.S.C. 154(b) by 992 days.

(21) Appl. No.: 11/176,475

(22) Filed: Jul. 8, 2005

(65) Prior Publication Data

US 2006/0011846 A1 Jan. 19, 2006

(30) Foreign Application Priority Data

Jul. 14, 2004 (JP) ..... 2004-206882

(51) Int. Cl.
*G09G 3/30* (2006.01)

(52) U.S. Cl. ..... 345/76; 345/82; 315/169.3

(58) Field of Classification Search ..... 345/76, 345/82, 211, 212, 532, 600, 572, 214, 77, 345/89, 90, 690, 699; 315/169.3; 396/159; 257/59, 72

See application file for complete search history.

(56) References Cited

U.S. PATENT DOCUMENTS 5,247,190 A 9/1993 Friend et al.
5,399,502 A 3/1995 Friend et al.
5,708,451 A 1/1998 Baldi
5,778,146 A 7/1998 Kawasaki et al.
6,011,529 A 1/2000 Ikeda
6,191,534 B1 2/2001 Schuler et al.
6,219,017 B1 4/2001 Shimada et al.
6,249,268 B1 6/2001 Tachibana et al.
6,414,661 B1 7/2002 Shen et al.

(Continued)

FOREIGN PATENT DOCUMENTS

EP 1 071 070 A2 1/2001

(Continued)

OTHER PUBLICATIONS

Tsutsui et al., "Electrominescence in Organic Thin Films", Photochemical Processes in Organized Molecular Systems, 1991, pp. 437-450 (Elsevier Science Publishers, Tokyo, 1991).

(Continued)

*Primary Examiner*—Abbas I Abdulselam
(74) *Attorney, Agent, or Firm*—Nixon Peabody, LLP; Jeffrey L. Costellia

(57) ABSTRACT

Accumulated usage data of each pixel of the correction circuit is divided into a plurality of data portions, each of which is stored in a different storing means. For example, the accumulated usage data is divided into the upper bit and the lower bit to be stored separately, and the upper bit of the accumulated usage data is obtained by adding the upper bit to a half carry generated by the calculation of the lower bit of the accumulated usage data. A degradation coefficient selected based on the thus obtained accumulated usage data is multiplied by video data to obtain corrected video data. The invention also provides a control circuit of a display device integrated with such a correction circuit.

20 Claims, 10 Drawing Sheets

U.S. PATENT DOCUMENTS

| | | | | |
|---|---|---|---|---|
| 6,456,337 | B1 | 9/2002 | Kobayashi et al. | |
| 6,473,065 | B1 | 10/2002 | Fan | |
| 6,501,230 | B1 | 12/2002 | Feldman | |
| 6,518,962 | B2 | 2/2003 | Kimura et al. | |
| 6,525,683 | B1 | 2/2003 | Gu | |
| 6,542,260 | B1 | 4/2003 | Gann et al. | |
| 6,618,084 | B1 | 9/2003 | Rambaldi et al. | |
| 6,628,848 | B1 | 9/2003 | Nakamura | |
| 6,771,281 | B2 | 8/2004 | Takagi | |
| 6,812,651 | B2 | 11/2004 | Iwata et al. | |
| 7,053,874 | B2 * | 5/2006 | Koyama | 345/82 |
| 7,148,629 | B2 * | 12/2006 | Ha et al. | 315/169.3 |
| 2001/0020922 | A1 | 9/2001 | Yamazaki et al. | |
| 2001/0045929 | A1 | 11/2001 | Prache et al. | |
| 2002/0030449 | A1 | 3/2002 | Okazaki et al. | |
| 2002/0033783 | A1 | 3/2002 | Koyama | |
| 2002/0047550 | A1 | 4/2002 | Tanada | |
| 2002/0089291 | A1 | 7/2002 | Kaneko et al. | |
| 2002/0101395 | A1 | 8/2002 | Inukai | |
| 2002/0105279 | A1 | 8/2002 | Kimura | |
| 2002/0180721 | A1 | 12/2002 | Kimura et al. | |
| 2003/0063053 | A1 | 4/2003 | Yamazaki et al. | |
| 2003/0063081 | A1 | 4/2003 | Kimura et al. | |
| 2003/0071804 | A1 | 4/2003 | Yamazaki et al. | |
| 2004/0008166 | A1 | 1/2004 | Kimura | |
| 2005/0270254 | A1 | 12/2005 | Ozaki | |

FOREIGN PATENT DOCUMENTS

| | | | |
|---|---|---|---|
| EP | 0 923 067 | B1 | 8/2004 |
| GB | 2 106 299 | A | 4/1983 |
| JP | 10-92576 | | 4/1998 |
| JP | 11-305722 | | 11/1999 |
| WO | WO 90/13148 | | 11/1990 |
| WO | WO 01/54107 | A1 | 7/2001 |
| WO | WO 01/63587 | A2 | 8/2001 |

OTHER PUBLICATIONS

M. A. Baldo et al., "Highly Efficient Phosphorescent Emission from Organic Electroluminescent Devices", Nature vol. 395, Sep. 10, 1998, pp. 151-154.

M. A. Baldo et al., Very High-Efficiency Green Organic Light-Emitting Devices Based on Electrophosphorescence:, Applied Physics Letters vol. 75, No. 1, Jul. 5, 1999, pp. 4- 6.

Tsutsui et al., "High Quantum Efficiency in Organic Light-Emitting Devices with Iridium-Complex as Triplet Emissive Center", Japanese Journal of Applied Physics vol. 38, Part 12B, Dec. 15, 1999, pp. L1502-L1504.

H. Shenk et al., "Polymers for Light-Emitting Diodes", Euro Display Proceedings 1999, pp. 33-37.

T. Shimoda et al., "Current Status and Future of Light-Emitting Polymer Display Driven by Poly-Si TFT" Society for Information Display—International Symposium Digest of Technical Papers,vol. XXX, May 18-20, 1999 Digest pp. 372-375.

Tatsuya Shimoda et al.,"High Resolution Light Emitting Polymer Display Driven by Low Temperature Polysilicon Thin Film Transistor with Integrated Driver", Asia Display 1998, pp. 217-220.

Chang Wook Han et al., "Green OLED With Low Temperature Poly Si TFT". EuroDisplay—The 19th International Display Research Conference, Late-News Papers, Sep. 6-9, 1999, pp. 27-30.

* cited by examiner

VIDEO DATA CORRECTION CIRCUIT, CONTROL CIRCUIT OF DISPLAY DEVICE, AND DISPLAY DEVICE AND ELECTRONIC APPARATUS INCORPORATING THE SAME

BACKGROUND OF THE INVENTION

1. Field of the Invention

The present invention relates to a display device using a light emitting element in a pixel portion. More particularly, the invention relates to a display device using a light emitting element typified by an organic electroluminescence (EL) element in a pixel portion and having a video data correction circuit for correcting video data in accordance with the degradation of the light emitting element. Further, the invention relates to a display device that has a display panel where a light emitting element such as an EL element is provided in each pixel, a control circuit having a storing means for storing video data, and a video data correction circuit for correcting the degradation of the light emitting element.

2. Description of the Related Art

As a substitute for an LCD (Liquid Crystal Display), there is a display device that is constituted by a display panel having a light emitting element in each pixel and a peripheral circuit for inputting a signal to the panel, and that displays images by controlling light emission of the light emitting element.

Such a display device includes a control circuit for outputting to a display panel a panel control signal as well as video data obtained by converting a received video signal so as to achieve gray scale display in a pixel of the panel. In the display panel of the display device, typically two or three TFTs (Thin Film Transistors) are provided in each pixel, and a current supplied to a light emitting element in each pixel, that is, the luminance and light emission/non-light emission of the light emitting element in each pixel are controlled by controlling on/off of these TFTs. In addition, a driver circuit for controlling on/off of the TFTs in each pixel is provided at the periphery of the pixel portion of the panel. This driver circuit may be constituted by TFTs that are formed at the same time as the TFTs in the pixel portion. These TFTs may be either N-channel TFTs or P-channel TFTs.

Gray scale display in the pixel having the aforementioned configuration is performed typically by an analog method or a digital method. The digital method is advantageous in that it is not influenced by variations in characteristics of TFTs. Known as a digital gray scale display method are a time gray scale method and an area gray scale method.

According to the time gray scale method, gray scale display is performed by controlling a period during which each pixel of a display device emits light. When it is assumed that one image is displayed during one frame period, one frame period is divided into a plurality of subframe periods. Light emission or non-light emission of each pixel is selected for each subframe period (that is, a light emitting element in each pixel emits light or no light), and each subframe period is weighted (that is, each subframe period has a different display period). The accumulated light emitting periods are controlled by selecting the subframe periods (that is, by selecting a combination of subframe periods during which a pixel emits light), thereby gray scale display in each pixel can be performed.

According to the area gray scale method, gray scale display is performed by controlling an area that emits light in each pixel of a display device. Specifically, each pixel is divided into subpixels and the number of subpixels that emit light is changed, thereby gray scale display in each pixel can be performed.

When a light emitting element such as an EL element is used, a current is always supplied to the EL element to flow therethrough during a period when the EL element emits light. Accordingly, the EL element itself degrades when it emits light for a long period, which causes variations in luminance characteristics. That is to say, an EL element that has degraded and an EL element that has not degraded have different luminance even when a current is supplied from the same current source at the same voltage.

Therefore, some display devices using a light emitting element such as an EL element include a video data correction circuit in order to maintain the uniformity of a screen while preventing luminance variations even when an EL element in a certain pixel degrades. The video data correction circuit detects the lighting time or the lighting time and lighting intensity of each pixel by periodically sampling a video data signal, and compares the detected accumulation value to previously stored data on changes with time of luminance characteristics of the EL element. As a result, it is possible to correct the video data signal for driving a pixel including an EL element that has degraded.

As such a display device, there is, for example, a self-light emitting display device having a degradation correction function, which is disclosed in Patent Document 1. FIG. 10 is a block diagram of a degradation correction device. The degradation correction device shown in FIG. 10 is constituted by a counter portion I, a storage circuit portion II, and a signal correction portion III. The counter portion I includes a counter 1002, the storage circuit portion II includes a volatile memory 1003 and a nonvolatile memory 1004, and the signal correction portion III includes a correction circuit 1005 and a correction data storage portion 1006. In this degradation correction device, video data for driving a pixel including an EL element that has degraded, which is included in a first video signal 1001A that is a video data signal before being corrected, is corrected by the signal correction portion III and supplied to a display device 1007 as a second video signal 1001B that is a video data signal after being corrected.

In this degradation correction device, the first video signal 1001A is sampled periodically (e.g., every second), and light emission or non-light emission of each pixel is counted by a counter 1002 depending on the sampled signal. The counted number of lighting times in each pixel, namely an accumulated lighting time (hereinafter referred to as accumulated time data) is sequentially stored in the storage circuit portion II. The storage circuit is desirably configured by using a nonvolatile memory since the number of lighting times is accumulated. However, the number of writing times to a nonvolatile memory is generally limited; therefore, in the device shown in FIG. 10, the data is stored in the volatile memory 1003 during operation of the self-light emitting device and written to the nonvolatile memory 1004 periodically (e.g., every hour, or when the power is turned off). That is to say, the lighting time or the lighting time and lighting intensity of the EL element are counted continuously the next time the power is turned on.

[Patent Document 1] Japanese Patent Laid-Open No. 2002-175041

SUMMARY OF THE INVENTION

According to the conventional video data correction circuit having the aforementioned configuration, however, both the volatile memory and the nonvolatile memory incorporated in the circuit have large capacitance, leading to increased number of connection pins. In addition, the area occupied by the circuit increases with the increase in the number of bits, which prevents miniaturization and reduction in the production cost of a product. Further, low power consumption becomes difficult with the increase in the number of RAMs with large capacitance.

The invention is made to solve such problems of the conventional technologies, and provides a video data correction circuit that requires no memory with large capacitance and has a configuration with a smaller number of memories incorporated in a circuit. The invention also provides a display device and an electronic apparatus incorporating the video data correction circuit and a driving method thereof.

In view of the foregoing, according to the invention, accumulated usage data (accumulated data on lighting time or lighting time and lighting intensity) of each pixel in a video data correction circuit is divided into a plurality of data portions, and each of the data portions is stored in a different storing means, thereby a memory element with large capacitance is not required to be used.

More specifically, a video data correction circuit of the invention has a detecting means for detecting usage data of each pixel by sampling video data supplied to a display device including a pixel using a light emitting element, an accumulated data storing means including a plurality of storing means and storing accumulated usage data of each pixel, an adding means for adding the usage data of each pixel detected by the detecting means to the accumulated usage data of each pixel stored in the accumulated data storing means, thereby writing the addition result to the accumulated data storing means as new accumulated usage data, and a correcting means for generating corrected video data by correcting the video data in accordance with the accumulated usage data stored in the accumulated data storing means. The accumulated usage data is divided into a plurality of data portions, each of which is stored in a different storing means selected from the plurality of storing means.

According to the aforementioned video data correction circuit of a display device, each data portion of the accumulated usage data of each pixel is stored in a different storing means. Consequently, the capacitance of a memory element constituting each storing means can be reduced; therefore, simple configuration, space saving, and reduction in the production cost of the circuit can be achieved due to the reduction in the number of connection pins.

The accumulated usage data of each pixel may be accumulated usage data based on the lighting time of each pixel or the lighting time and lighting intensity of each pixel.

The correcting means may have, in order to obtain the corrected video data for each pixel, a multiplying means for multiplying the video data by a degradation coefficient selected from a plurality of degradation coefficients in accordance with the accumulated usage data.

The correcting means may also have a delay circuit for correcting a time lag between the selection of a corresponding degradation coefficient and the input of the video data, which is connected to a video data input terminal of the multiplying means.

The plurality of data portions may be a first data portion and a second data portion and the plurality of storing means may be a first storing means and a second storing means. The first data portion may be stored in the first storing means while the second data portion may be stored in the second storing means.

If the plurality of data portions are the first data portion and the second data portion, the first storing means of the accumulated data storing means may be a first volatile storing means while the second storing means may be a second volatile storing means. In this case, the accumulated data storing means may further include a nonvolatile storing means that has a backup area for storing the content of the first volatile storing means and the second volatile storing means when the power is turned off and for transferring the content to the first volatile storing means and the second volatile storing means when the power is turned on. The nonvolatile storing means may further include a degradation coefficient storage area for previously storing the plurality of degradation coefficients. In addition, the first data portion may be a lower bit of the accumulated usage data while the second data portion may be an upper bit of the accumulated usage data.

Alternatively, if the plurality of data portions are the first data portion and the second data portion, the first storing means of the accumulated data storing means may be a volatile storing means while the second storing means may be a nonvolatile storing means. In this case, the nonvolatile storing means may further include a backup area for storing the content of the volatile storing means when the power is turned off and for transferring the content to the volatile storing means when the power is turned on. The nonvolatile storing means may further include a degradation coefficient storage area for previously storing the plurality of degradation coefficients. In addition, the first data portion may be the lower bit of the accumulated usage data while the second data portion may be the upper bit of the accumulated usage data. In such a case, the adding means may have a first adding means for adding the usage data of each pixel detected by the detecting means to the lower bit of the accumulated usage data of each pixel stored in the volatile storing means, thereby writing the addition result to the volatile storing means as the lower bit of new accumulated usage data, and a second adding means for adding a half carry generated by the addition result of the first adding means to the upper bit of the accumulated usage data of each pixel stored in the nonvolatile storing means, thereby writing the addition result to the nonvolatile storing means as the upper bit of new accumulated usage data. Further in this case, a half carry storing means for storing the half carry generated by the addition result of the first adding means may be provided. The degradation coefficient multiplied by the video data by the multiplying means may be selected based on only the upper bit of the accumulated usage data.

Another embodiment mode of the invention provides an integrated control circuit where the aforementioned video data correction circuit is incorporated in a control circuit of a display device that converts a supplied video signal into video data capable of performing gray scale display in the display device.

More specifically, a first control circuit of the invention includes a first volatile storing means and a second volatile storing means each having an area for storing video data supplied to a display device having a pixel using a light emitting element, a reading means for reading the video data from either the first volatile storing means or the second volatile storing means and supplying the video data to a display panel, wherein storing means from which the video data is read is switched between the first volatile storing means and the second volatile storing means every time one or more images are displayed, a detecting means for detecting usage data of each pixel by sampling the video data, an accumulated data storing means for storing the accumulated usage data of each pixel, which includes a volatile area corresponding to an area other than an area of the first and second volatile storing means, which stores the video data, and a nonvolatile area corresponding to an area of a nonvolatile storing means, an adding means for adding the usage data of each pixel detected by the detecting means to the accumulated usage data of each pixel stored in the accumulated data storing means, thereby writing the addition result to the accumulated data storing means as new accumulated usage data, and a writing means for converting a supplied video signal into the video data capable of performing gray scale display in the display device and for correcting the video data based on the accumulated usage data stored in the accumulated data storing means, thereby writing the corrected video data to either the first volatile storing means or the second volatile storing means, from which video data is not read. The accumulated usage data is divided into a first data portion and a second data portion, and the first data portion is stored in the volatile area while the second data portion is stored in the nonvolatile area. The adding means has a first adding means and a second adding means. The first adding means reads the first data portion from the volatile area, does addition in the first data portion, and writes the addition result to the volatile area. Meanwhile, the second adding means reads the second data portion from the nonvolatile area, does addition in the second data portion, and writes the addition result to the nonvolatile area.

By using such a first control circuit, the aforementioned advantages of the video data correction circuit of the invention can be obtained, and further miniaturization and reduction in the production cost of the peripheral circuit of the display device and the entire display device can be achieved.

The accumulated usage data of each pixel may be accumulated usage data based on the lighting time of each pixel or the lighting time and lighting intensity of each pixel.

The correcting means may have, in order to obtain the corrected video data for each pixel, a multiplying means for multiplying the video data by a degradation coefficient selected from a plurality of degradation coefficients in accordance with the accumulated usage data.

The correcting means may also have a read degradation coefficient storing means for temporarily storing the read degradation coefficient, connected to a degradation coefficient input terminal of the multiplying means.

The correcting means may further have a delay circuit for correcting a time lag between the selection of a corresponding degradation coefficient and the input of the video data, which is connected to a video data input terminal of the multiplying means.

The nonvolatile storing means may include a backup area for storing the content of the volatile storing means when the power is turned off and for transferring the content to the volatile storing means when the power is turned on. The nonvolatile storing means may also include a degradation coefficient storage area for previously storing the plurality of degradation coefficients.

The first data portion may be the lower bit of the accumulated usage data while the second data portion may be the upper bit of the accumulated usage data. In such a case, the second adding means may have a configuration for adding a half carry generated by the addition result of the first adding means to the upper bit of the accumulated usage data of each pixel stored in the nonvolatile storing means, thereby writing the addition result to the nonvolatile storing means as the upper bit of new accumulated usage data. Further in this case, a half carry storing means for storing the half carry generated by the addition result of the first adding means may be provided. The degradation coefficient multiplied by the video data by the multiplying means may be selected based on only the upper bit of the accumulated usage data.

According to another embodiment mode of the invention, in the aforementioned control circuit of a display device, a storing means for storing a first data portion of video data and accumulated usage data is constituted by one memory element. The video data is read by sequentially reading a predetermined amount of video data (e.g., video data for one row of a panel) corresponding to a display timing of a display panel of the display device during a plurality of clock periods, and the video data is written to the memory element in the remaining time.

More specifically, a second control circuit of the invention includes a volatile storing means having a first area and a second area each storing video data supplied to a display device having a pixel using a light emitting element, a reading means for reading the video data from either the first area or the second area of the volatile storing means and supplying the video data to a display panel, wherein an area from which the video data is read is switched between the first area and the second area every time one or more images are displayed and a predetermined amount of video data corresponding to a display timing of the display panel is sequentially read from the volatile storing means during a plurality of clock periods, a detecting means for detecting usage data of each pixel by sampling the video data, an accumulated data storing means for storing the accumulated usage data of each pixel, which includes a third area corresponding to an area other than the first and second areas of the volatile storing means and fourth and fifth areas corresponding to an area of a nonvolatile storing means, an adding means for adding the usage data of each pixel detected by the detecting means to the accumulated usage data of each pixel stored in the accumulated data storing means, thereby writing the addition result to the accumulated data storing means as new accumulated usage data, and a correcting and writing means for converting a supplied video signal into the video data capable of performing gray scale display in the display device and for correcting the video data based on the accumulated usage data stored in the accumulated data storing means, thereby writing the corrected video data to either the first area or the second area, from which video data is not read. The accumulated usage data is divided into a first data portion and a second data portion, and the first data portion is stored in the third area of the volatile storing means while the second data portion is stored in the fourth and fifth areas of the nonvolatile storing means. The adding means has a first adding means and a second adding means. The first adding means reads the first data portion from the third area, does addition in the first data portion, and writes the addition result to the third area. Meanwhile, the second adding means reads the second data portion from either the fourth area or the fifth area, does addition in the second data portion, and writes the addition result to either the fourth area or the fifth area, from which data is not read. An area for reading the second data portion is switched between the fourth area and the fifth area every time one or more images are displayed.

By using such a second control circuit, only one memory element is needed for constituting the volatile storing means; therefore, the aforementioned advantages of the video data correction circuit and the first control circuit of the invention can be obtained, and further miniaturization and reduction in the production cost of the peripheral circuit of the display device and the entire display device can be achieved. In addition, when video data is read by sequentially reading a predetermined amount of video data corresponding to a display timing of the display panel of the display device during a plurality of clock periods, a limit in the access timing to one memory element constituting the volatile storing means can be minimized as well as a limit in the format of video data to be stored in the volatile storing means, which increases the physical usability of the storing means.

The accumulated usage data of each pixel in the second control circuit may be accumulated usage data based on the lighting time of each pixel or the lighting time and lighting intensity of each pixel.

The correcting and writing means may have, in order to obtain the corrected video data for each pixel, a multiplying means for multiplying the video data by a degradation coefficient selected from a plurality of degradation coefficients in accordance with the accumulated usage data.

The correcting and writing means may also have a read degradation coefficient storing means for temporarily storing the read degradation coefficient, which is connected to a degradation coefficient input terminal of the multiplying means.

The read degradation coefficient storing means may include a first read degradation coefficient storing means for temporarily storing a degradation coefficient corresponding to video data of n pixels (n is a positive integer) multiplied by the multiplying means at a time, and a second read degradation coefficient storing means for storing the degradation coefficient corresponding to video data of n pixels stored in the first read degradation coefficient storing means once in a period of receiving j pixels (j is a positive integer), thereby supplying the degradation coefficient to the multiplying means in synchronism with the timing of receiving a video signal.

The nonvolatile storing means may include a backup area for storing the content of the volatile storing means when the power is turned off and for transferring the content to the volatile storing means when the power is turned on. In this case, the backup area may be either the fourth area or the fifth area, from which the second data portion is read immediately before the power is turned off. The nonvolatile storing means may also include a degradation coefficient storage area for previously storing the plurality of degradation coefficients. In such a case, a degradation coefficient storing means may be provided, which reads the degradation coefficient stored in the degradation coefficient storage area of the nonvolatile storing means when the power is turned on and caches the read degradation coefficient to be supplied to the multiplying means.

The first data portion may be the lower bit of the accumulated usage data while the second data portion may be the upper bit of the accumulated usage data. In such a case, the second adding means may have a configuration for adding a half carry generated by the addition result of the first adding means to the upper bit of the accumulated usage data of each pixel stored in the nonvolatile storing means, thereby writing the addition result to the nonvolatile storing means as the upper bit of new accumulated usage data. Further in this case, the correcting and writing means may have a configuration for writing the video data as well as the half carry generated by the addition result of the first adding means to either the first area or the second area, from which video data is not read. In addition, the reading means may include a half carry temporarily storing means for reading the video data as well as the half carry from the first area or the second area and for temporarily storing the read half carry as well as the video data.

The half carry temporarily storing means may have a configuration for dividing all the pixels into K pixel groups (K is a positive integer) and storing a half carry corresponding to each of the K pixel groups. According to this, the half carry temporarily storing means no longer requires a memory element with large capacitance, leading to space saving and reduction in the production cost of the circuit.

Writing of the addition result of the second data portion by the second adding means may be performed once in the shortest time between the occurrence of a half carry by the first adding means and the occurrence of the next half carry. In addition, the degradation coefficient multiplied by the video data by the multiplying means may be selected based on only the upper bit of the accumulated usage data.

The reading means may include a read video data storing means for storing the predetermined amount of video data during a predetermined storage period.

The correcting and writing means may include, in order to write to the volatile storing means, a writing video data storing means for storing a predetermined amount of the video data optimized for writing to the volatile storing means during a predetermined writing video data storage period.

Further, the correcting and writing means may include an excess video data storing means for temporarily storing a part of the predetermined amount of video data stored in the writing video data storing means, which has not been written to the volatile storing means during the writing video data storage period, and for writing the video data to the volatile storing means while the reading operation of the video data is not performed.

According to another embodiment mode of the invention, provided is a driving method of a video data correction circuit for converting video data supplied to a display device having a pixel using a light emitting element into corrected video data. The driving method of the video data correction circuit includes a detecting step of detecting usage data of each pixel by sampling the video data, a storing step of dividing accumulated usage data into a plurality of data portions and storing the data portions in an accumulated data storing means having a plurality of storing means, an adding step of adding the usage data of each pixel detected in the detecting step to the accumulated usage data of each pixel stored in the accumulated data storing means and writing the addition result to the accumulated data storing means as new accumulated usage data, and a correcting step of generating corrected video data by correcting the video data based on the accumulated usage data stored in the accumulated data storing means. The storing step includes a step of storing the respective data portions in the corresponding different memory means.

According to the aforementioned driving method of the video data correction circuit, the respective data portions of the accumulated usage data of each pixel are stored in different memory means in the video data correction circuit. Consequently, the capacitance of a memory element constituting each storing means can be reduced; therefore, simplified configuration, space saving, and reduction in the production cost of a circuit can be achieved due to the reduction in the number of connection pins.

According to another embodiment mode of the invention, provided is a driving method of a first control circuit that converts a supplied video signal into video data capable of performing gray scale display in a display device having a pixel using a light emitting element, converts the video data into corrected video data, and has a first volatile storing means and a second volatile storing means each storing the corrected video data. The driving method of the first control circuit of the invention includes a reading step of reading the corrected video data from either the first volatile storage memory means or the second volatile storing means, a step of supplying a display panel with the corrected video data read from either the first volatile storing means or the second volatile storing means, a detecting step of detecting usage data of each pixel by sampling the video data, a storing step of dividing accumulated usage data into a first data portion and a second data portion and storing the data portions in an accumulated data storing means having a volatile area corresponding to an area other than an area of the first and second volatile storing means, which stores the video data, and a nonvolatile area corresponding to an area of a nonvolatile storing means, an adding step of adding the usage data of each pixel detected in the detecting step to the accumulated usage data of each pixel stored in the accumulated data storing means and writing the addition result to the accumulated data storing means as new accumulated usage data, and a correcting and writing step of converting a supplied video signal into the video data capable of performing gray scale display in the display device, converting the video data into the corrected video data based on the accumulated usage data stored in the accumulated data storing means, and writing the corrected video data to either the first volatile storing means or the second volatile storing means, from which video data is not read. The storing step includes a step of storing the first data portion in the volatile area and storing the second data portion in the nonvolatile area. The adding step includes a first adding step of reading the first data portion from the volatile area, doing addition in the first data portion, and writing the addition result to the volatile area, and a second adding step of reading the second data portion from the nonvolatile area, doing addition in the second data portion, and writing the addition result to the nonvolatile area. The reading step includes a step of switching storing means for reading the corrected video data between the first volatile storing means and the second volatile storing means every time one or more images are displayed.

By using the driving method of the first control circuit, the aforementioned advantages of the driving method of the video data correction circuit can be obtained, and further miniaturization and reduction in the production cost of the peripheral circuit of the display device and the entire display device can be achieved.

According to another embodiment mode of the invention, provided is a driving method of a second control circuit that converts a supplied video signal into video data capable of performing gray scale display in a display device having a pixel using a light emitting element, converts the video data into corrected video data, and has a volatile storing means including a first area and a second area each storing the corrected video data. The driving method of the second control circuit of the invention includes a reading step of sequentially reading a predetermined amount of corrected video data corresponding to a display timing of the display panel from either the first area or the second area of the volatile storing means during a plurality of clock periods, a step of supplying the display panel with corrected video data read from the volatile storing means, a detecting step of detecting usage data of each pixel by sampling the video data, a storing step of dividing accumulated usage data into a first data portion and a second data portion and storing the data portions in an accumulated data storing means that includes a third area corresponding to an area other than the first and second areas of the volatile storing means and fourth and fifth areas corresponding to an area of a nonvolatile storing means, an adding step of adding the usage data of each pixel detected by the detecting means to the accumulated usage data of each pixel stored in the accumulated data storing means and writing the addition result to the accumulated data storing means as new accumulated usage data, and a correcting and writing step of converting a supplied video signal into the video data capable of performing gray scale display in the display device, converting the video data into the corrected video data based on the accumulated usage data stored in the accumulated data storing means, and writing the corrected video data to either the first area or the second area, from which video data is not read. The storing step includes a step of storing the first data portion in the third area and storing the second data portion in the fourth and fifth areas. The adding step includes a first adding step of reading the first data portion from the third area, doing addition in the first data portion, and writing the addition result to the third area, and a second adding step of reading the second data portion from either the fourth area or the fifth area, doing addition in the second data portion, and writing the addition result to either the fourth area or the fifth area, from which video data is not read. The reading step includes a step of switching an area for reading the corrected video data between the first area and the second area every time one or more images are displayed. The second adding step includes a step of switching an area for reading the second data portion between the fourth area and the fifth area every time one or more images are displayed.

By using the driving method of the second control circuit, only one memory element is needed for constituting the volatile storing means; therefore, the aforementioned advantages of the driving method of the video data correction circuit and the first control circuit of the invention can be obtained, and further miniaturization and reduction in the production cost of the peripheral circuit of the display device and the entire display device can be achieved. In addition, a limit in the access timing to one memory element constituting the volatile storing means can be minimized as well as a limit in the format of video data to be stored in the volatile storing means, which increases the physical usability of the storing means.

A display device incorporating the video data correction circuit or the control circuit of the invention may have a display panel where a light emitting element is provided in each pixel, and the video data correction circuit or the control circuit of the invention.

As a result, miniaturization and reduction in the production cost of the peripheral circuit including the video data correction circuit or the control circuit can be achieved, leading to miniaturization and reduction in the production cost of the display device. Note that the display device incorporating the control circuit of the invention may be driven with an area gray scale method or a time gray scale method to perform gray scale display. A light emitting element typified by an EL element includes a pair of electrodes and a layer containing a light emitting material provided therebetween. The light emitting element generates one or both of light emitted in returning from an excited singlet state to a ground state (fluorescence) and light emitted in returning from an excited triplet state to a ground state (phosphorescence).

According to the invention, as set forth above, a video data correction circuit of a display device has a configuration where accumulated usage data (accumulated data on the lighting time or the lighting time and lighting intensity) of each pixel is divided into a plurality of data portions and the respective data portions are stored in different memory means. Accordingly, a memory with large capacitance is no longer required, and reduction in the number of pins to be mounted, simplification of the configuration, and space saving of the circuit can be achieved. As a result, it is possible to realize miniaturization, reduction in production cost, improved reliability, and lower power consumption of a display device and an electronic apparatus each having the video data correction circuit of the invention.

DETAILED DESCRIPTION OF THE INVENTION

Embodiment Mode 1

Figure 1:
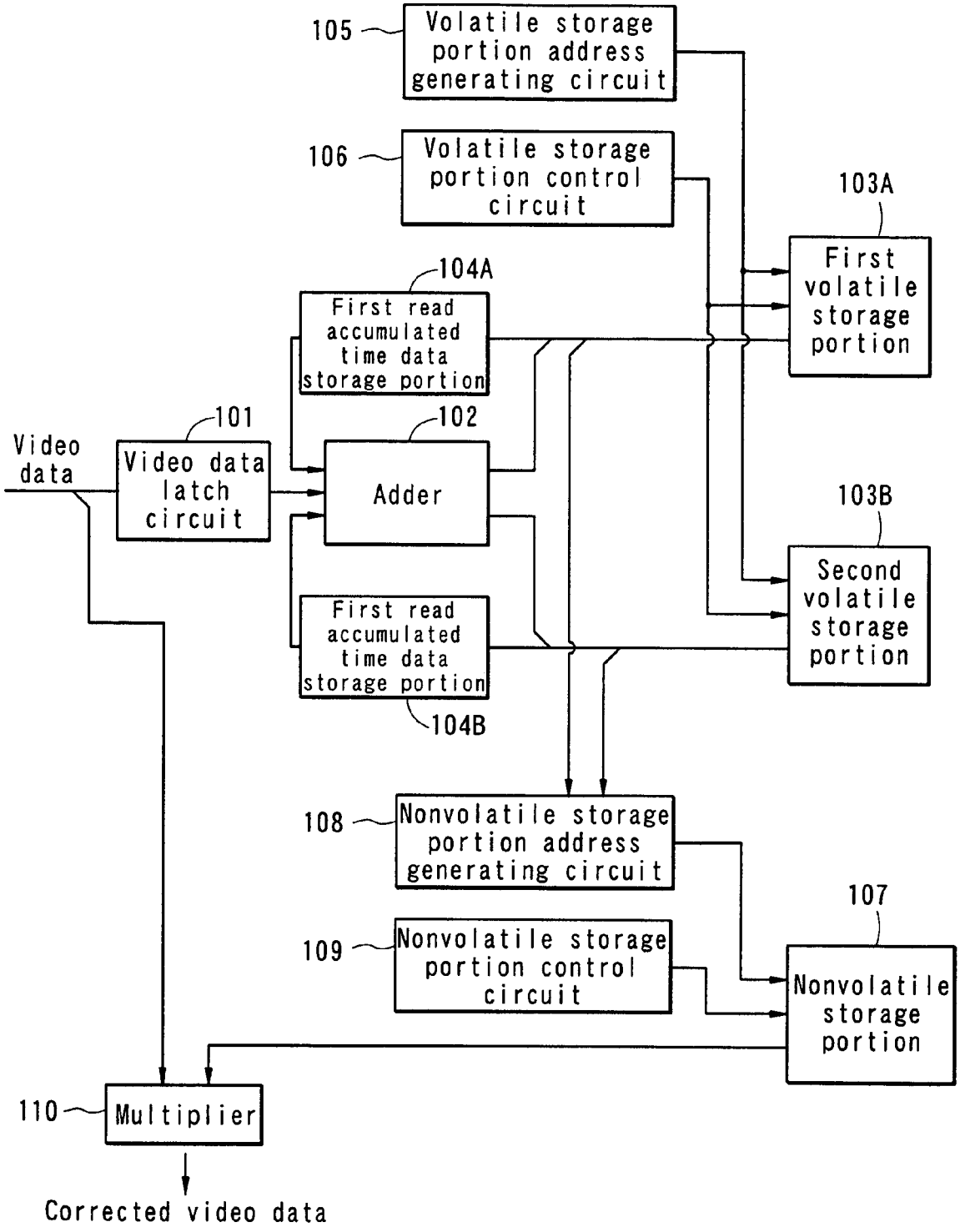
FIG. 1 is a block -diagram showing a configuration example of a video data correction circuit according to Embodiment Mode 1 of the invention.

FIG. 1 is a schematic view showing a configuration example of a video data correction circuit according to the invention. The video data correction circuit includes a video data latch circuit 101 for latching video data to be sampled, an adder 102 for generating new accumulated time data by adding lighting time estimated from the sampled video data to the previous accumulated time data, a first volatile storage portion 103A and a second volatile storage portion 103B each of which is a volatile storing means for storing accumulated time data, a nonvolatile storage portion 107 that is a nonvolatile storing means for storing a degradation coefficient and creating a backup of the content of the first volatile storage portion 103A and the second volatile storage portion 103B when the power is turned off, and a multiplier 110 for generating corrected video data by multiplying the video data by a degradation coefficient corresponding to accumulated lighting time of each pixel.

A volatile storage portion address generating circuit 105 and a volatile storage portion control circuit 106 are provided as control means of both the first volatile storage portion 103A and the second volatile storage portion 103B. A nonvolatile storage portion address generating circuit 108 and a nonvolatile storage portion control circuit 109 are provided as a control means of the nonvolatile storage portion 107. The video data correction circuit further includes a first read accumulated time data storage portion 104A for reading and temporarily storing accumulated time data to be added to sampled video data from the first volatile storage portion 103A, and a second read accumulated time data storage portion 104B for reading and temporarily storing accumulated time data from the second volatile storage portion 103B.

Although a conventional video data correction circuit uses one volatile storing means for accumulating the lighting time of each pixel, the video data correction circuit of the invention uses the first volatile storage portion 103A and the second volatile storage portion 103B as shown in FIG. 1, and accumulated time data is divided into two portions each of which is stored in each of the volatile storage portions. This embodiment mode shows an example where the accumulated time data is divided into the upper bit and the lower bit that are stored in the first volatile storage portion 103A and the second volatile storage portion 103B respectively. However, the invention is not limited to this and the accumulated time data is not necessarily divided into the higher bit and the lower bit to be stored in each volatile storage portion. For example, the accumulated time data may be divided into RG video data and B video data so as to be stored in the first volatile storage portion 103A and the second volatile storage portion 103B respectively.

Operation of the aforementioned video data correction circuit is described. First, data on changes with time of luminance characteristics of a light emitting element of a display device, which is typified by an EL element, is previously stored in the nonvolatile storage portion 107 as a degradation coefficient for correcting video data depending on the degradation rate so as to prevent the influence of the degradation.

Video data (VD) inputted to the video data correction circuit is periodically sampled by the video data latch circuit 101. The number of lighting and non-lighting times of each pixel is counted based on the video data, and divided into data portions to be sequentially stored in the first volatile storage portion 103A and the second volatile storage portion 103B. That is to say, the adder 102 adds lighting time data of each pixel based on the video data sampled by the video data latch circuit 101 to accumulated time data (AT) whose upper bit is read from the first volatile storage portion 103A to the first read accumulated time data storage portion 104A while lower bit is read from the second volatile storage portion 103B to the second read accumulated time data storage portion 104B. The new accumulated lighting time data obtained from the addition result is divided into the upper bit and the lower bit to be stored in the first volatile storage portion 103A and the second volatile storage portion 103B respectively.

On the other hand, the video data is supplied to a multiplier 110 to be multiplied by a degradation coefficient supplied from the nonvolatile storage portion 107 therein. According to this, the video data is converted into corrected video data where lighting time is corrected in accordance with the rate of changes with time of each pixel, and then outputted from the video data correction circuit. Such a degradation coefficient for correcting the lighting time in accordance with the degradation rate of each pixel is supplied by referring to the accumulated time data stored in the first volatile storage portion 103A and the second volatile storage portion 103B and by specifying an address of the nonvolatile storage portion 107, which stores the degradation coefficient corresponding to the accumulated lighting time of each pixel.

In order to prevent accumulated time data stored in the first volatile storage portion 103A and the second volatile storage portion 103B from being lost when the power is turned off, this embodiment mode adopts a backup method where the accumulated time data is transferred (stored) to the nonvolatile storage portion 107 immediately before the power is turned off and the accumulated time data stored in the nonvolatile storage portion 107 is transferred (recalled) to the first volatile storage portion 103A and the second volatile storage portion 103B when the power is turned on.

In this embodiment mode, a degradation coefficient is read directly from the nonvolatile storage portion 107 when correcting video data. However, a degradation coefficient may be read from the first volatile storage portion 103A or the second volatile storage portion 103B when correcting video data, to which the degradation coefficient has been written in advance.

In this manner, accumulated time data is stored by periodically sampling the lighting time of a light emitting element and video data is corrected by referring to data on changes with time of the light emitting element, which has been stored in advance. As a result, corrected video data can be supplied, such that the light emitting element that has degraded can have the same luminance as the light emitting element that has not degraded. Thus, the uniformity of a screen can be maintained in the display device while preventing luminance variations.

If gray scale display is performed by controlling the luminance of an EL element, it is desirable that the degradation rate of the light emitting element be determined by detecting the lighting time and the lighting intensity of the EL element. In such a case, data on the accumulated lighting time and lighting intensity is stored in the first volatile storage portion 103A and the second volatile storage portion 103B, and a degradation coefficient based on the accumulated usage obtained by taking into consideration the accumulated lighting time and lighting intensity is previously stored in the nonvolatile storage portion.

An element used for the storing means such as the first volatile storage portion 103A, the second volatile storage portion 103B and the nonvolatile storage portion 107 may be a static memory (SRAM), a dynamic memory (DRAM), a ferroelectric memory (FeRAM), an EEPROM, a flash memory, or the like. However, the invention is not limited to these and any memory element that is used generally can be employed. If a DRAM is used for the volatile memory, a function of periodically refreshing is required to be added.

When accumulated time data is thus divided into the upper bit and the lower bit and accumulated time data of each data portion is stored in a different memory means, a memory with large capacitance is no longer required for a volatile storing means. Accordingly, the number of connection pins is reduced and the area occupied by the circuit decreases, which results in miniaturization and reduction in production cost.

Embodiment Mode 2

Figure 2:
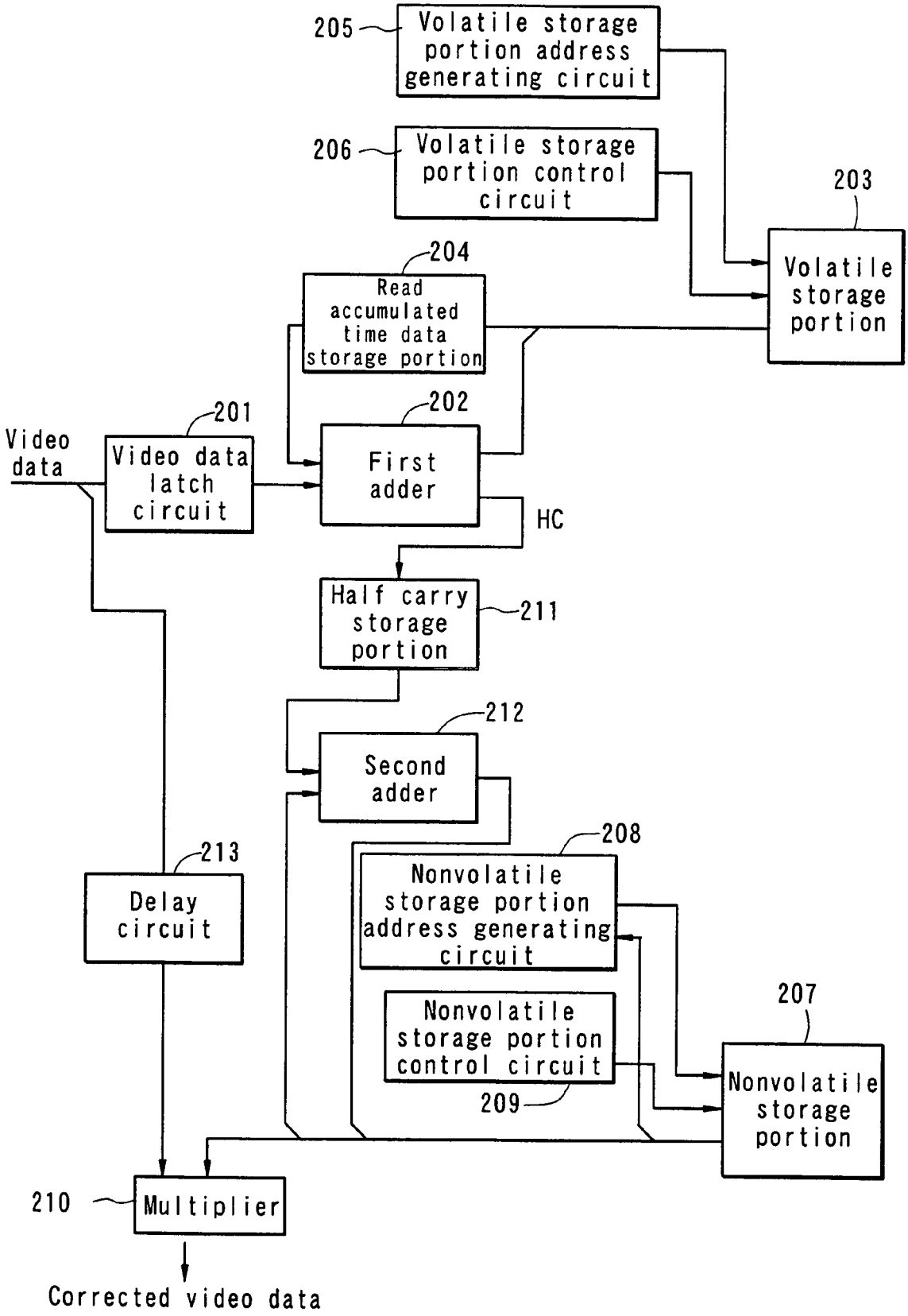
FIG. 2 is a block diagram showing a configuration example of a video data correction circuit according to Embodiment Mode 2 of the invention.

FIG. 2 is a schematic view showing a configuration example of a video data correction circuit of the invention, which is different than the one shown in Embodiment Mode 1. The video data correction circuit shown in Embodiment Mode 2 has a similar configuration to the one shown in Embodiment Mode 1, except in that only one volatile storage portion is provided to store the lower bit and half carry of accumulated time data and the upper bit of the accumulated time data is stored in the remaining address area of a nonvolatile storage portion.

The configuration and operation of the video data correction circuit according to this embodiment mode are described more specifically with reference to FIG. 2. The video data correction circuit includes a video data latch circuit 201 for latching video data to be sampled, which functions as a lighting time accumulated portion, a volatile storage portion 203 for storing the lower bit and half carry (one or more bits) of accumulated time data, a nonvolatile storage portion 207 for storing the upper bit of the accumulated time data, a read accumulated time data storage portion 204 for reading and temporarily storing the lower bit and half carry (HC) of the accumulated time data from the volatile storage portion 203, and a first adder 202 for adding the lower bit and half carry of the accumulated time data stored in the read accumulated time data storage portion 204 to lighting time estimated from the video data sampled by the video data latch circuit 201. The video data is taken in, for example, every 60 frames, though the invention is not limited to this. The half carry is set to "1" if a carry is generated in the addition of the lower bit of the accumulated time data. Further, a volatile storage portion address generating circuit 205 and a volatile storage portion control circuit 206 are provided as a control means of the volatile storage portion 203, and a nonvolatile storage portion address generating circuit 208 and a nonvolatile storage portion control circuit 209 are provided as a control means of the nonvolatile storage portion 207.

The half carry generated in the add operation of the first adder 202 is written to the volatile storage portion 203 with the lower bit of the accumulated time data obtained from the addition result, or transferred to a half carry storage portion 211 and stored therein. In the case where the half carry is transferred to the half carry storage portion 211, the half carry stored in the volatile storage portion 203 is reset.

If the half carries of all the pixels are stored in the half carry storage portion 211, large capacitance is required for a memory element of the half carry storage portion 211 when the number of pixels is large. In order to reduce the capacitance of the memory element, a pixel area may be divided into K pixel areas (K is a natural number) and only the half carry of one of the K pixel areas may be transferred to the half carry storage portion 211. According to this, the capacitance of the half carry storage portion 211 can be reduced to 1/K.

It is assumed that, for example, only the half carry of the k-th pixel area (k is an integer from 1 to K) is transferred to the half carry storage portion. The nonvolatile storage portion control circuit 209 periodically reads the upper bit of the accumulated time data corresponding to the k-th pixel area stored in the nonvolatile storage portion 207, to which the half carry read from the half carry storage portion 211 is added by a second adder 212, and the addition result is written to the nonvolatile storage portion 207. At this time, the adding and writing operations are not performed if all the bits of the half carry storage portion 211 are "0". When the aforementioned operations are thus completed in the k-th pixel area, the similar operations are performed in the (k+1)th pixel area (the first area in the case of k=K).

The nonvolatile storage portion 207 stores the aforementioned upper bit of the accumulated time data as well as a degradation coefficient similarly to Embodiment Mode 1. The upper bit of the accumulated time data is read from the nonvolatile storage portion 207 every reception period of video data, and inputted to the nonvolatile storage portion address generating circuit 208. Then, an address of the nonvolatile storage portion 207 is generated, which stores a degradation coefficient corresponding to the accumulated lighting time represented by the upper bit of the accumulated time data, and the degradation coefficient is read. A multiplier 210 multiplies the video data by the read degradation coefficient, thereby corrected video data corrected to prevent the influence of degradation with time can be obtained. Note that there may be a time lag between the input of the video data and the input of the degradation coefficient to the multiplier 210, because of a time interval between the reading of the accumulated time data and the input of the degradation coefficient to the multiplier 210. In such a case, a delay circuit 213 may be provided in order to correct the time lag before inputting the video data to the multiplier 210. This correction is similarly performed for a video data synchronization control signal. However, the delay circuit 213 is not necessarily provided when there is no need to correct the time lag.

Only the upper bit of the accumulated time data read from the nonvolatile storage portion is used for the correction in the above description. Alternatively, as another mode, not only the upper bit of the accumulated time data read from the nonvolatile storage portion but also the lower bit of the accumulated time data read from the volatile accumulated time data storage portion may be used as accumulated time data for specifying the degradation coefficient.

In order to prevent the lower bit of the accumulated time data stored in the volatile storage portion 203 from being lost when the power is turned off, this embodiment mode adopts, similarly to Embodiment Mode 1, a backup method where the lower bit of the accumulated time data is transferred (stored) to the nonvolatile storage portion 207 immediately before the power is turned off and the lower bit of the accumulated time data stored in the nonvolatile storage portion 207 is transferred (recalled) to the volatile storage portion 203 when the power is turned on.

In this embodiment mode, a degradation coefficient is read directly from the nonvolatile storage portion 207 when correcting video data. However, a degradation coefficient may be read from the volatile storage portion 203 when correcting video data, to which the degradation coefficient has been written in advance.

In this manner, lighting time data is accumulated by periodically sampling the lighting time of a light emitting element, and corrected video data is supplied by correcting the accumulated time data. Thus, the uniformity of a screen can be maintained in the display device while preventing luminance variations.

If gray scale display is performed by controlling the luminance of an EL element similarly to Embodiment Mode 1, correcting data is made so as to determine the degradation rate of the light emitting element by detecting the lighting time and the lighting intensity. In such a case, data on the accumulated lighting time and lighting intensity is stored in the volatile storage portion 203 and the nonvolatile storage portion 207, and a degradation coefficient based on the accumulated usage obtained by taking into consideration the accumulated lighting time and lighting intensity is stored in the nonvolatile storage portion 207 in advance.

An element used for the storing means such as the volatile storage portion 203 and the nonvolatile storage portion 207 may be a static memory (SRAM), a dynamic memory (DRAM), a ferroelectric memory (FeRAM), an EEPROM, a flash memory, or the like. Instead, any memory element that is used generally can be employed.

The accumulated time data is thus divided into the upper bit and the lower bit, and only the lower bit is stored in the volatile storage portion while the upper bit is written and stored in the remaining address area of the nonvolatile storage portion. As a result, half of the number of bits is required for the volatile storing means. In addition, since it is not necessary to create a backup of the upper bit in the nonvolatile memory, the necessary time and power consumption of the backup operation can be reduced to half. Accordingly, a small circuit scale can be achieved, which results in miniaturization, lower power consumption, and reduction in the production cost of the product, and improved reliability of the circuit.

Embodiment Mode 3

In this embodiment mode, the lower bit of accumulated lighting time data produced by a video data correction circuit is stored in an unused address area of a storing means such as a video memory used in a display control circuit, while the upper bit of the accumulated lighting time data is stored in a nonvolatile storing means, and the data is read as needed to correct video data. That is to say, the video data correction circuit described in Embodiment Modes 1 and 2 is integrated with a control circuit of a display device. Note that the control circuit of a display device converts the format of a received video signal to be able to perform gray scale display in pixels of a display panel, writes the converted video data to a storing means, and outputs to the display panel a panel control signal and the video data read from the storing means for displaying images.

Figure 3:
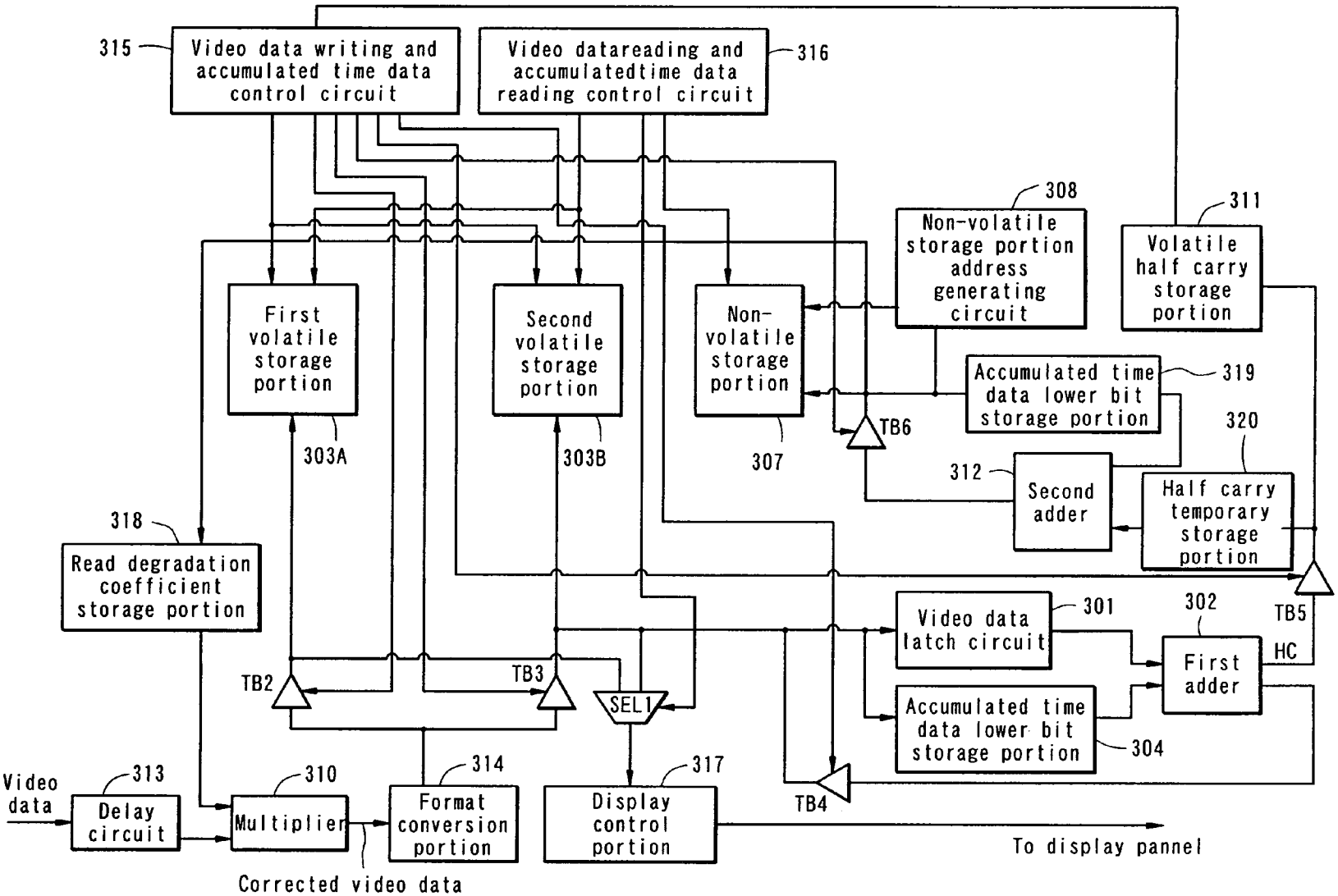
FIG. 3 is a block diagram showing a configuration example of a control circuit of a display device incorporating a video data correction circuit according to Embodiment Mode 3 of the invention.

FIG. 3 is a schematic view of an integrated control circuit where a video data correction circuit of the invention is integrated with a control circuit of a display device. The control circuit shown in FIG. 3 includes, as main storing means, a first volatile storage portion 303A, a second volatile storage portion 303B, a volatile half carry storage portion 311, and a nonvolatile storage portion 307 that is a rewritable nonvolatile storing means. The nonvolatile storage portion 307 stores the upper bit (UB) of accumulated time data. The first volatile storage portion 303A and the second volatile storage portion 303B each has an address area for storing video data of one frame whose format is converted to perform time gray scale display. The second volatile storage portion 303B stores the lower bit (LB) of the accumulated time data and a half carry (1 or more bits). The half carry (HC) is set to "1" if a carry is generated in the addition of the lower bit of the accumulated time data.

A portion constituting a control circuit of a display device in the integrated circuit shown in FIG. 3 mainly includes a format converting portion 314 for converting a received video signal to be able to perform gray scale display (e.g., time gray scale display) in pixels of a display panel, the first volatile storage portion 303A and the second volatile storage portion 303B for storing video data, and a display control circuit 317 for reading the video data from the first and second volatile storage portions and transferring the video data to the display panel. The other portions mainly constitute a video data correction circuit. In addition, a video data writing and accumulated time data control circuit 315 and a video data reading and accumulated time data reading control circuit 316 are provided as common circuits for controlling video data writing and reading of both the control circuit of a display device and the video data correction circuit. The configuration and operation of the aforementioned integrated circuit in FIG. 3 are described hereinafter in (1) operation as the control circuit of a display device and (2) operation as the video data correction circuit.

(1) Operation as the Control Circuit of a Display Device

First, operation until corrected video data is transferred to a display panel is described. In a certain frame, corrected video data is converted to be able to perform gray scale display (e.g., time gray scale display) in pixels of the display panel by the format converting portion 314. Then, the converted video data is written to either the first volatile storage portion 303A or the second volatile storage portion 303B, which is a main video memory, through a tri-state buffer TB2 or TB3. At the same time, video data is read from either the first volatile storage portion 303A or the second volatile storage portion 303B, to which video data is not written, through a selector SEL1, and then transferred to the display panel through the display control circuit 317. If video data is written to the first volatile storage portion 303A while video data is read from the second volatile storage portion 303B in a certain frame, video data is written to the second volatile storage portion 303B while video data is read from the first volatile storage portion 303A in the next frame. In other words, the first volatile storage portion 303A and the second volatile storage portion 303B are switched between the portion to which data is written and the portion from which data is read every time a frame is changed.

(2) Operation as the Video Data Correction Circuit

Next, accumulation operation of lighting time data is described. In a frame period during which video data is written to the second volatile storage portion 303B, the lower bit and half carry of accumulated time data are read from the second volatile storage portion 303B, and stored in an accumulated time data lower bit storage portion 304. Then, a first adder 302 adds the lower bit and half carry of the accumulated time data stored in the accumulated time data lower bit storage portion 304 to a lighting time estimated from video data sampled by a video data latch circuit 301. The half carry generated at this time is stored in the half carry storage portion 311 through a tri-state buffer TB5 in the period described below. Note that the half carry stored in the second volatile storage portion 303B is reset when being transferred to the half carry storage portion 311 (it is not reset when not being transferred thereto). The lower bit of the accumulated time data obtained by the first adder 302 is stored in the second volatile storage portion 303B through a tri-state buffer TB4.

In this embodiment mode, the lower bit and half carry of the accumulated time data are written to the second volatile storage portion 303B, namely one of the two volatile storage portions, though they may be stored in both the first volatile storage portion 303A and the second volatile storage portion 303B when the second volatile storage portion 303B does not have an enough area. In this case, the data is accumulated in the first volatile storage portion 303A in the same manner as in the second volatile storage portion 303B.

The half carry storage portion 311 may be constituted by a memory element incorporated in a device including a circuit, or a memory with small capacitance constituted by one or more line buffers and the like. Alternatively, an unused area of the first volatile storage portion 303A and the second volatile storage portion 303B may be utilized as the half carry storage portion 311.

On the other hand, the upper bit of the accumulated lighting time data is stored in the nonvolatile storage portion 307. The video data reading and accumulated time data reading control circuit 316 periodically reads the upper bit of the accumulated time data from the nonvolatile storage portion 307 to an accumulated time data upper bit storage portion 319, while it reads the half carry from the half carry storage portion 311 to a half carry temporary storage portion 320. Then, the upper bit of the accumulated time data is added to the half carry by a second adder 312, and the addition result is written to the nonvolatile storage portion 307 through a tri-state buffer TB6. The half carry stored in the half carry storage portion 311 is reset to "0" when being read and added in the second adder 312. Note that if all the data of the half carry storage portion 311 is "0" (there is no carry), the aforementioned adding operation is not performed.

Large capacitance is required for a memory element of the half carry storage portion 311 when data on the half carry of all the pixels is stored therein. In such a case, similarly to Embodiment Mode 2, a pixel area may be divided into K pixel areas (K is a natural number) and only the half carry of one of the K pixel areas may be stored in the half carry storage portion 311 in order to reduce the capacitance of the memory element. That is to say, only the half carry of the k-th pixel area (k is an integer from 1 to K) is transferred to the half carry storage portion 311, while the other data is maintained to be stored in the second volatile storage portion 303B. After the half carry and upper bit of the accumulated time data of the k-th pixel area are stored, the same operation is performed in the (k+1)th pixel area (the first area in the case of k=K). According to this, the capacitance of the half carry storage portion 311 can be reduced to 1/K.

Correcting operation of video data is described next. The video data writing and accumulated time data control circuit 315 reads from the nonvolatile storage portion 307 the upper bit of the accumulated time data corresponding to received video data. In accordance with the read upper bit, an address of the nonvolatile storage portion 307 is generated by a nonvolatile storage portion address generating circuit 308, and a degradation coefficient stored in the address of the nonvolatile storage portion 307 is read to a read degradation coefficient storage portion 318. The video data to be corrected is inputted to a delay circuit 313 to correct delay time required for the aforementioned operation. The corrected video data can be obtained by multiplying by a multiplier 310 the video data outputted from the delay circuit 313 by the degradation coefficient read to the read degradation coefficient storage portion 318.

Further, in order to prevent the content stored in the volatile storage portion from being lost when the power is turned off, the lower bit and half carry of the accumulated time data that have been written to one or both of the first volatile storage portion 303A and the second volatile storage portion 303B are transferred to the nonvolatile storage portion 307 to create a backup of the content. Meanwhile, the backup data stored in the nonvolatile storage portion 307 is transferred (recalled) to the first volatile storage portion 303A or the like when the power is turned on.

In this manner, lighting time data is accumulated by periodically sampling the lighting time of a light emitting element, and corrected video data is supplied by correcting the accumulated time data. Thus, the uniformity of a screen can be maintained in the display device while preventing luminance variations.

If gray scale display is performed by controlling the luminance of an EL element similarly to Embodiment Modes 1 and 2, correcting data is made so as to determine the degradation rate of the light emitting element by detecting the lighting time and the lighting intensity. In such a case, data on the accumulated lighting time and lighting intensity is stored in the second volatile storage portion 303B and the nonvolatile storage portion 307, and a degradation coefficient based on the accumulated usage obtained by taking into consideration the accumulated lighting time and lighting intensity is stored in the nonvolatile storage portion 307 in advance.

An element used for the storing means such as the first volatile storage portion 303A, the second volatile storage portion 303B, and the nonvolatile storage portion 307 may be a static memory (such as SRAM), a dynamic memory (such as DRAM), a ferroelectric memory (such as FeRAM), an EEPROM, a flash memory, or the like. Instead, any memory element that is used generally can be employed.

The accumulated time data is thus divided into the upper bit and the lower bit, and the lower bit is stored in an unused area of the storing means such as a video memory used in the display control circuit while the upper bit is stored in the nonvolatile storing means. As a result, the video data correction circuit can be integrated with the control circuit of a display device, and a volatile memory for accumulating time data is no longer required to be provided separately. In addition, the display control circuit and the video data correction circuit can be incorporated in the same device; therefore, a mounting area and the number of pins to be mounted can be significantly reduced, which results in miniaturization and reduction in the production cost of the product, and improved reliability of the circuit. Further, since the upper bit of the accumulated time data is stored in the nonvolatile storing means, the necessary time and power consumption of the backup operation when the power is off can be reduced to half or less.

Embodiment Mode 4

In this embodiment mode, similarly to Embodiment Mode 3, the upper bit of accumulated lighting time data is stored in a non-volatile storing means while the lower bit of the accumulated lighting time data produced by a video data correction circuit is stored in an unused address area of a storing means such as a video memory used in a display control circuit, thereby the video data correction circuit is integrated with a control circuit of a display device. In addition, in Embodiment Mode 4, only one volatile memory element is used for a volatile storing means such as a video memory, which stores video data whose format has been converted, the lower bit of accumulated time data, and the like. Two areas are provided for storing video data whose format has been converted, one of which is used for reading and the other is used for writing. The reading area and the writing area are switched every predetermined period.

When one storing means of video data includes a reading address area and a writing address area, at least three memory accesses (two reading operations and one writing operation) are needed in, for example, a source clock half period, leading to a strict limit in the memory access timing. In such a case, some limits occur: a memory with high power consumption is required, a high internal frequency is achieved using a high performance device, and the like. In order to avoid these limits, video data reading from a video data storage portion is not performed in synchronism with a source clock half period. Instead, a predetermined amount of video data corresponding to a display timing of a display panel of a display device is sequentially read during a plurality of clock periods, temporarily stored in a read video data storing means, and transferred to the display panel. Meanwhile, the writing operation is performed during a period when the reading operation is not performed until a writing video data storage portion is rewritten.

According to such a method, a volatile storing means can be constituted by one memory element in an integrated control circuit where a video data correction circuit is integrated with a control circuit of a display device. Further, the problem of memory access timing does not occur; therefore, it is not necessary to use a memory with high power consumption and achieve a high internal clock frequency using a high performance device, leading to reduction in the number of pins to be mounted, simplification of the configuration, and space saving of the circuit. In addition, since the read video data storing means (see a read video data storage portion 424 in FIG. 4) buffers the read video data, a limit in the amount of video data stored in each address of a volatile storage portion can be minimized, which increases the physical usability of the volatile storage portion.

Figure 4:
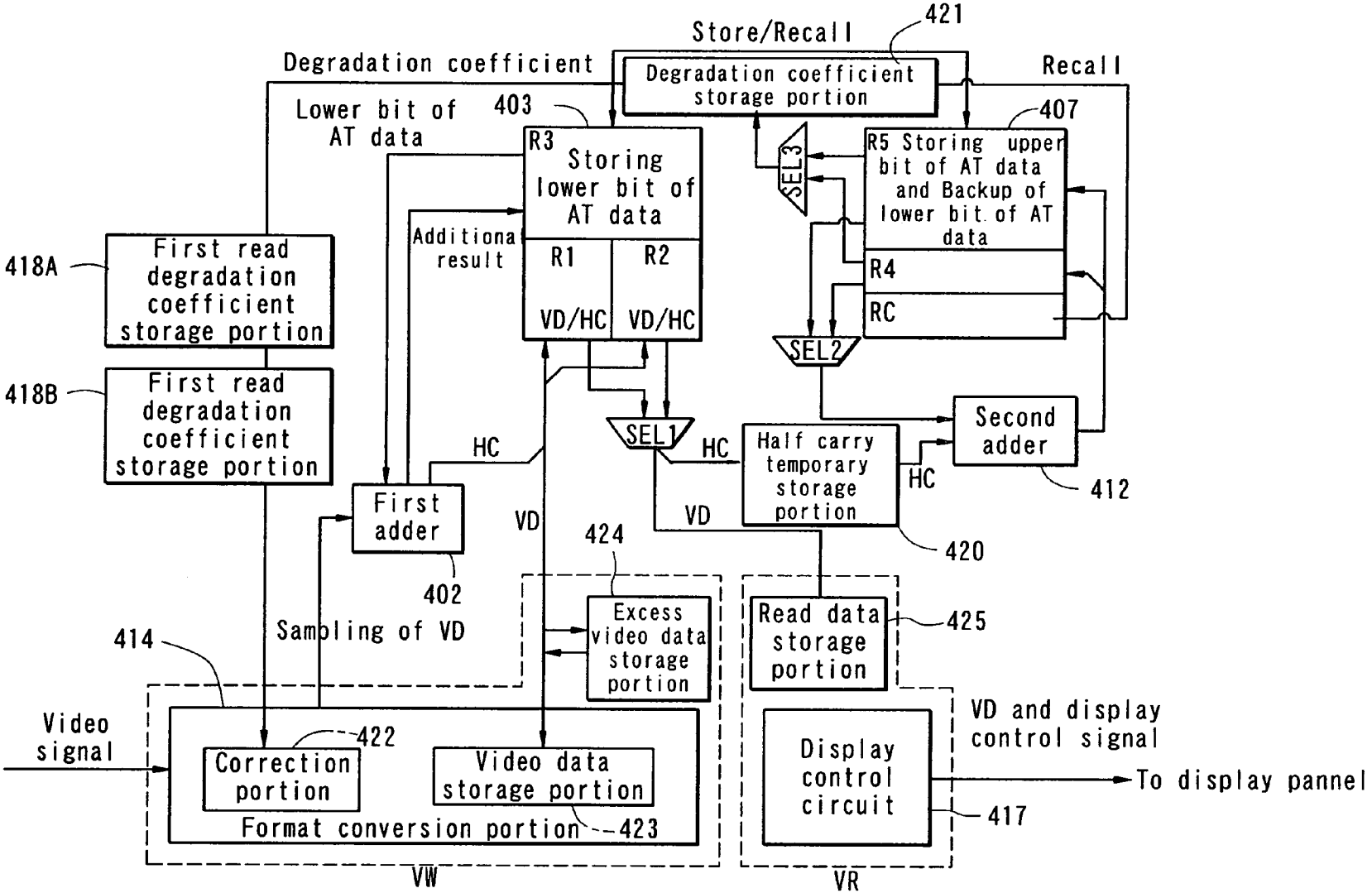
FIG. 4 is a block diagram showing a configuration example of a control circuit of a display device incorporating a video data correction circuit according to Embodiment Mode 4 of the invention.

FIG. 4 is a schematic view of an integrated control circuit where the aforementioned video data correction circuit is integrated with a control circuit of a display device. The control circuit in FIG. 4 includes, as main storing means, a volatile storage portion 403 having one memory element, and a nonvolatile storage portion 407 that is a rewritable nonvolatile storing means. The volatile storage portion 403 includes three regions R1 to R3. The region R3 stores the lower bit of accumulate time data (AT), while each of the regions R1 and R2 stores video data (VD) whose format has been converted to be able to perform gray scale display in a display panel as well as a half carry (HC) generated by the calculation of the lower bit of the accumulated time data. The nonvolatile storage portion 407 includes a degradation coefficient region RC for degradation coefficient backup, and regions R4 and R5 each of which stores the upper bit of the accumulated time data (AT) and is used for creating a backup of the lower bit of the accumulated time data.

A portion constituting a control circuit of a display device in the integrated circuit shown in FIG. 4 mainly includes a video data writing portion VW, the regions R1 and R2 of the volatile storage portion 403, and a video data reading portion VR. The other portions mainly constitute a video data correction circuit. In the video data correction circuit portion, the accumulated lighting time data is divided into the upper bit and the lower bit to be processed.

The configuration and operation of such an integrated circuit shown in FIG. 4 are described for (1) video data writing portion and (2) video data reading portion that constitute the control circuit, and (3) accumulated time data lower bit storage portion, (4) accumulated time data upper bit storage portion, (5) video data correction portion, and (6) accumulated time data backup portion that constitute the video data correction circuit.

(1) Video Data Writing Portion VW

In the control circuit in FIG. 4, the video data writing portion VW includes a format converting portion 414 for converting the format of a received video signal to be able to perform gray scale display in the display panel. As set forth above, the video data writing portion VW writes data to either the region R1 or R2 of the volatile storage portion 403, from which data is not read, during a period when the reading operation from the volatile storage portion 403 is not performed. Accordingly, the format converting portion 414 includes a video data storage portion 423 for storing a predetermined amount of video data optimized for writing to the volatile storage portion 403 during a predetermined period (referred to as a writing video data storage period). The predetermined amount of video data stored in the writing video data storage portion 423 is written to either the region R1 or R2 of the volatile storage portion 403 through a connection controlling means such as a tri-state buffer and an analog switch at an appropriate timing. If writing of the predetermined amount of video data is not completed during a writing video data storage period and excess video data is generated, the excess video data is temporarily stored in an excess video data storage portion 424 with small capacitance that is provided in the video data writing portion VW as shown in FIG. 4, and written to either the region R1 or R2 during an excess period (extension period) of a frame period when the reading and writing operations are not performed. The format converting portion 414 of the control circuit also includes a correction portion 422 having a multiplier and the like for obtaining corrected video data by multiplying video data by a degradation coefficient. That is to say, in the format converting portion 414, degradation correction is performed at the same time as format conversion of video signal.

Figure 5:
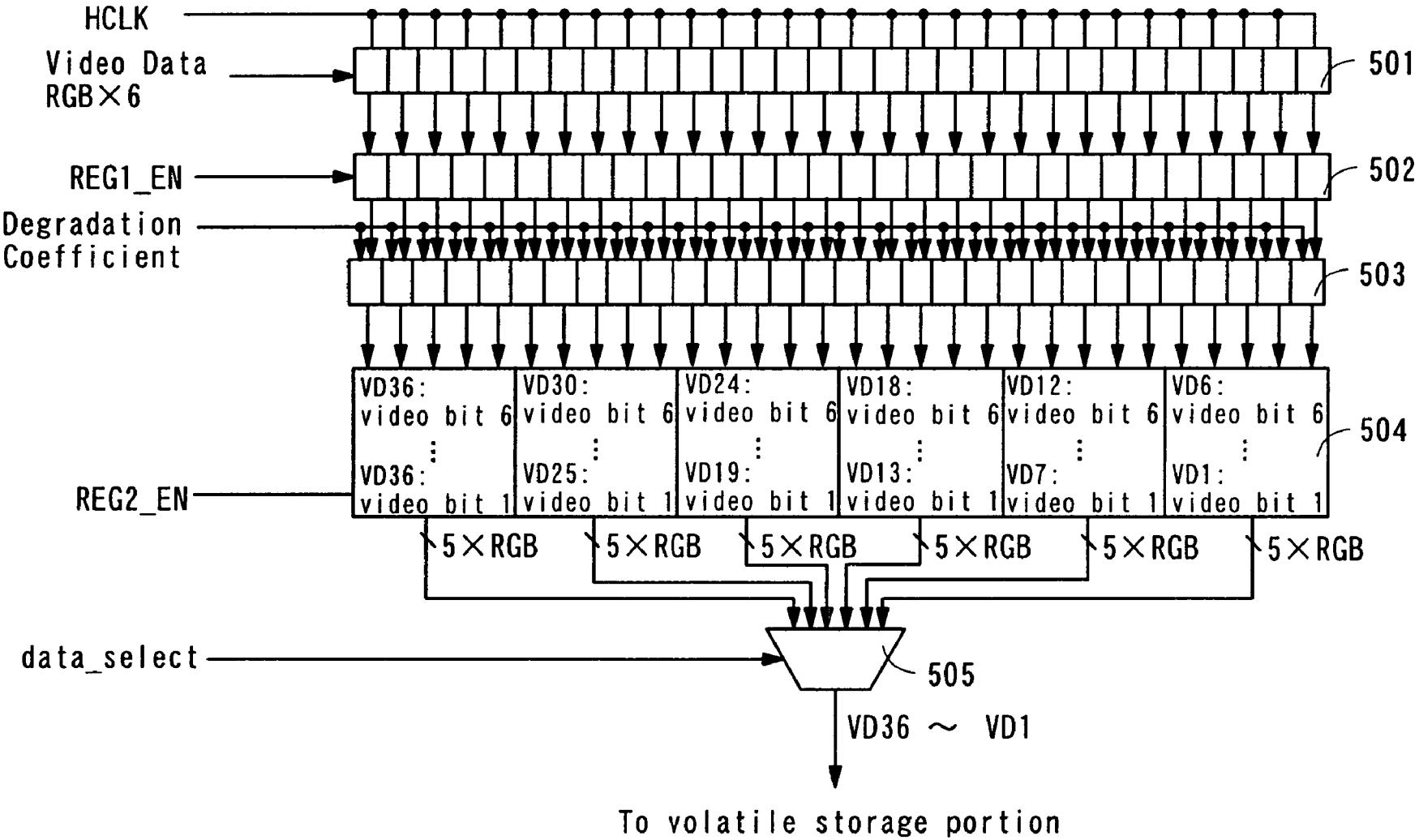
FIG. 5 is a schematic view showing an example of a circuit configuration of a format converting portion used in the control circuit shown in FIG. 4.

FIG. 5 shows a circuit configuration example of the format converting portion 414. The format converting portion 414 has n (n is a positive integer) shift registers 501, a first register 502, a multiplier 503, a second register 504, and a selector 505 for selecting from the video data storage portion 423 video data to be written to the volatile storage portion 403. HCLK denotes a hardware clock signal, REG1_EN denotes an enable signal of the first register 502, REG2_EN denotes an enable signal of the second register 504, and data_select denotes a control signal of the selector 505.

This embodiment mode shows an example where the number of the shift registers 501 is 30 (n=30), the number of video bits is 6 ($2^6$=64 gray scale levels), and one video bit corresponding to one pixel×RGB is received in parallel. Video data is received in synchronism with the clock signal HCLK and this period is referred to as a reception period. In other words, video data of one pixel (18 bits herein) is received during one reception period. The received video data is sequentially transferred to the 30 shift registers 501, and then inputted to the first register 502 at a time. The video data of each pixel stored in the first register 502 is multiplied by a degradation coefficient by the multiplier 503, and then transferred to the second register 504 after the next n reception periods (30 reception periods herein) at a time. According to the time gray scale method, one frame period is divided into a plurality of subframe periods and each bit of video data is displayed; therefore, each video bit is stored in the volatile memory separately. Thus, the video data inputted to the second register 504 is written to the volatile storage portion 403 (FIG. 4) using video bits of one or more pixels selected by the selector 505 as a writing unit. This embodiment mode shows an example where video bits of five pixels, namely five pixels×RGB=15 bits are used as a writing unit (VD1 to VD36). That is to say, video data is written 36 times during 30 reception periods. Note that writing to the volatile storage portion 403 is performed during a period when reading from the volatile storage portion 403 is not performed by the video data reading portion VR described below.

Figure 6:
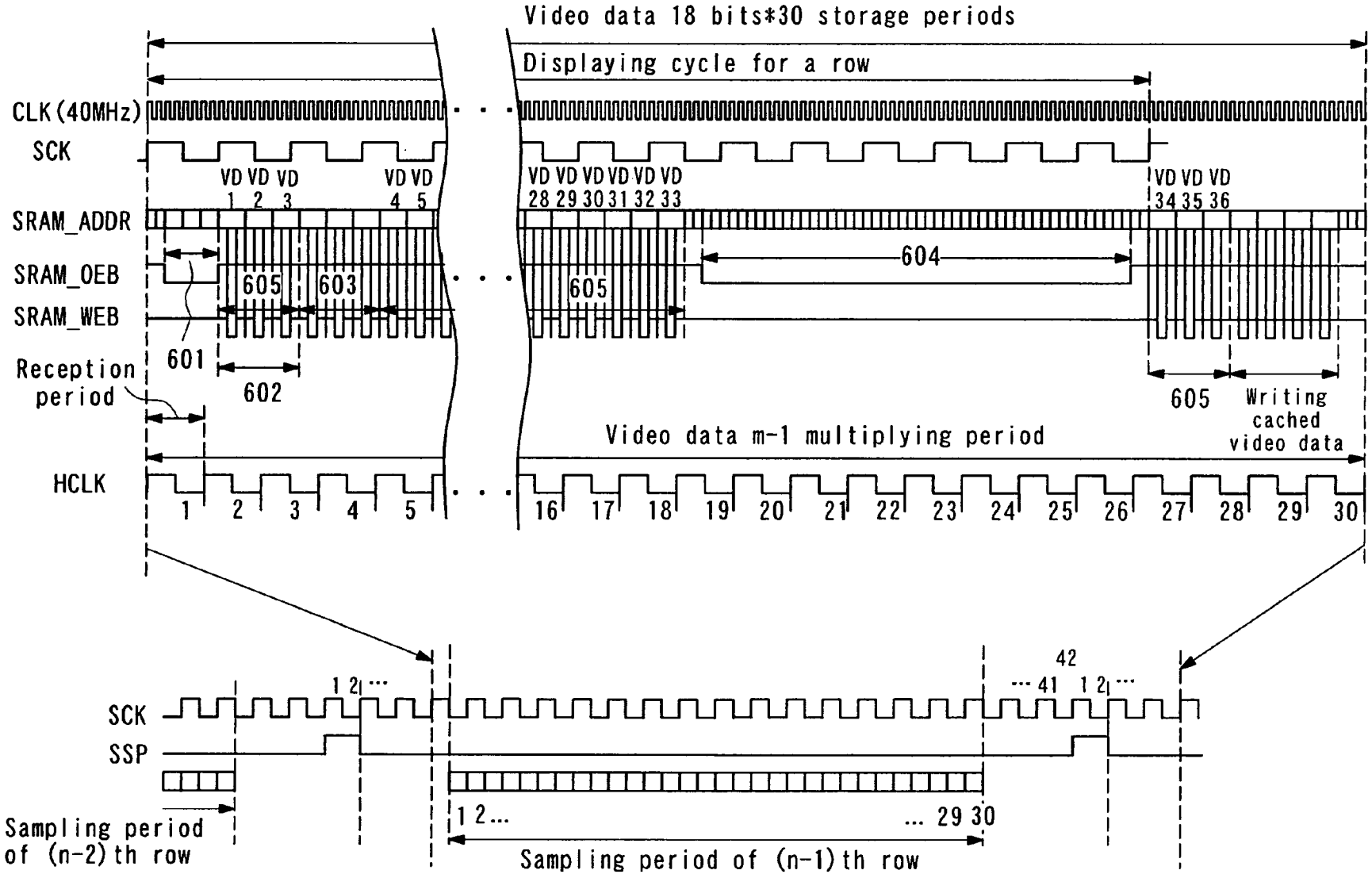
FIG. 6 is a timing chart showing an access timing for writing to and reading from a volatile storage portion in the control circuit shown in FIG. 4.

The timing of writing data to the volatile storage portion 403 is shown in FIG. 6 described in detail below. Brief description is made on the timing shown in FIG. 6. SRAM_OEB is a reading control signal that enables video data to be read from the volatile storage portion 403 when being at H level or L level (L level herein). SRAM_WEB is a writing control signal that enables video data to be written to the volatile storage portion 403 when being at H level or L level (L level herein). As shown in FIG. 6, the SRAM_WEB is brought into an enable state 36 times during a period when the video data of 30 reception periods is stored and the reading control signal SRAM_OEB is not in an enable state (L level), thereby the writing units VD1 to VD36 are written.

As set forth above, if writing of the video data is not completed during a period when the video data storage portion 423 (FIG. 4) including the second register 504 and the like temporarily stores video data (30 reception periods herein), the excess video data is temporarily stored in the excess video data storage portion 424 (FIG. 4), and written to the volatile storage portion 403 during an extension period of a frame period when the reading and writing operations are not performed, a non-display period after a subframe period, a non-reception period between frames, and the like.

(2) Video Data Reading Portion VR

In the integrated control circuit shown in FIG. 4, the video data reading portion VR has a read data storage portion 425 and a display control circuit 417. The read data storage portion 425 stores a predetermined amount of video data read from either the region R1 or R2 of the volatile storage portion 403 through a selector SELL during a predetermined period, and the display control portion 417 transfers the video data stored in the read video data storage portion 403 to the display panel in synchronism with the display timing. As described above, video data reading from the read video data storage portion 425 is not performed in synchronism with a source clock half period. Instead, the predetermined amount of video data is sequentially read during a plurality of clock periods. The predetermined amount of video data stored in the read video data storage portion 425 during a predetermined period corresponds to the display timing of the display panel. The video data of one row of the display panel can be taken as an example, though the amount of video data stored in the read video data storage portion 425 is not limited to this.

(3) Accumulated Time Data Lower Bit Storage Portion

The control circuit shown in FIG. 4 includes, as an accumulated time data lower bit storage portion of the video data correction circuit, a region R3 of the volatile storage portion 403 for storing the lower bit of the accumulated time data, and a first adder 402 for adding the lighting time of each pixel estimated from sampled video data to the lower bit of the accumulated time data that corresponds to the sampled video data and is stored in the region R3 of the volatile storage portion 403. The addition result of the first adder 402 is written to the region R3 of the volatile storage portion 403, and a half carry (HC) generated by the adding operation is written to either the region R1 or R2 of the volatile storage portion 403 with the video data. When the volatile storage portion 403 has an address of 16 bits and 15-bit video data (5×RGB) is written to one address, for example, the half carry may be written to the remaining one bit of the volatile storage portion 403. The half carry (HC) may be written to one or both of the regions R1 and R2 of the volatile storage portion 403.

In order to obtain video data used for calculation of accumulated lighting time, m video data (m is an integer from 1 to n) is sampled, which is selected from the video data received by the video data writing portion VW and stored in n shift registers of one row. For example, when the number of the shift registers of one row is 30 (n=30), the number of video bits is 6 ($2^6$=64 gray scale levels), and one video bit corresponding to one pixel×RGB is received in parallel as shown in the format converting portion in FIG. 5, m video data (m is an integer from 1 to 30) each having 18 bits (RGB×6) is sampled for calculating the accumulated time data. That is to say, the accumulated data is added to the sampled video data m times during a period when the video data writing portion VW stores video data of n reception periods. Accordingly, in a display panel with a frame frequency of 60 Hz, the accumulated data of one frame is added to the sampled video data by using m/n frame periods.

FIG. 6 is an access timing chart of the volatile storage portion 403, where a reception period is 160 ns, n is 30, m is 1, and an internal clock (CLK) frequency is 40 MHz. As set forth above, the SRAM_OEB is a reading control signal that enables video data to be read from the volatile storage portion 403 when being at H level or L level (L level herein). The SRAM_WEB is a writing control signal that enables video data to be written to the volatile storage portion 403 when being at H level or L level (L level herein). The HCLK is a hardware clock signal where one period is equal to one reception period as described above, SSP is a start pulse that starts a display cycle of a certain row, SCK is a source clock, and SRAM_ADDR denotes addresses VD1 to VD36 specified by an address generated by the address generating circuit of the volatile storage portion so as to write specific video data of a specific pixel. It is needless to say that the address generating circuit of the volatile storage portion specifies an address for reading specific video data and an address for reading and writing the upper bit of the accumulated time of a light emitting element.

Description is made on the timing of reading accumulated time data (from the region R3 of the volatile storage portion 403), accumulation calculation, and writing of the accumulated time data after the calculation. In FIG. 6, video data is sampled during one reception period of the 30 reception periods, and accumulated time data is read from the volatile storage portion 403 at the same time (accumulated time reading 601). After the accumulated time is calculated (accumulated lighting time count period 602), the addition result is written (writing of accumulated time count result 603).

Displaying video data is written and read at the following timing as described in the description of the video data writing portion VW. The SRAM_WEB is brought into an enable state 36 times during a period when the video data of 30 reception periods is stored and the reading control signal SRAM_OEB is not in an enable state (L level), thereby writing video data of one row is written. In FIG. 6, video data VD1 to VD36 of the (m−2)th row is written (writing of video data (m−2) 605) during a period other than a period when video data of the n-th row is read (reading of video data of the n-th row 604), and the accumulated time reading 601. Video data of the (n−1)th row is sampled during a period when the video data of the n-th row is read. Meanwhile, video data of the (m−1)th row is multiplied by a degradation coefficient during a period when the video data of the (m−2)th row is written.

(4) Accumulated Time Data Upper Bit Storage Portion

The control circuit shown in FIG. 4 includes, as an accumulated time data upper bit storage portion of the video data correction circuit, regions R4 and R5 of the nonvolatile storage portion for storing the upper bit of the accumulated time data, a half carry temporary storage portion 420 for temporarily storing a half carry read from the region R1 or R2 of the volatile storage portion 403, and a second adder 412 for adding the upper bit of the accumulated time data read from either the region R4 or R5 of the nonvolatile storage portion through a selector SEL2 to the half carry transferred to the half carry temporary storage portion 420. The half carry reading is performed at the same time as video data reading by the video data reading portion VR, and the half carry is read through the selector SELL from either the region R1 or R2 of the volatile storage portion 403, from which video data is read. Similarly to Embodiment Modes 2 and 3, a pixel area is divided into K pixel areas (K is a natural number) and only the half carry of one of the K pixel areas is stored in the half carry temporary storage portion 420 in order to reduce the capacitance of the memory element. That is to say, only the half carry of the k-th pixel area (k is an integer from 1 to K) is transferred to the half carry temporary storage portion 420. The second adder 412 adds the data stored in the half carry storage portion 420 to the upper bit of the accumulated time data read from either the region R4 or R5 of the nonvolatile storage portion during a predetermined half carry storage period for storing the data of the k-th pixel area. The addition result is written to either the region R4 or R5 from which data is not read. Then, the same operation is performed in the (k+1)th pixel area. When the operation in the K-th pixel area is completed, that is, when accumulating operation of the upper bit of the accumulated time data is completed in all the pixel areas of one frame, data is read from either the region R4 or R5 of the volatile storage portion, to which data is written in the previous frame, while data is written to the other region, thereby accumulating operation is performed in the first pixel area of the next frame. In other words, the reading area and the writing area are switched between the regions R4 and R5 of the nonvolatile storage portion every frame period. Although the upper bit of the accumulated time data is accumulated using a frame period as a reference unit, other reference units may be used as well.

Figure 7:
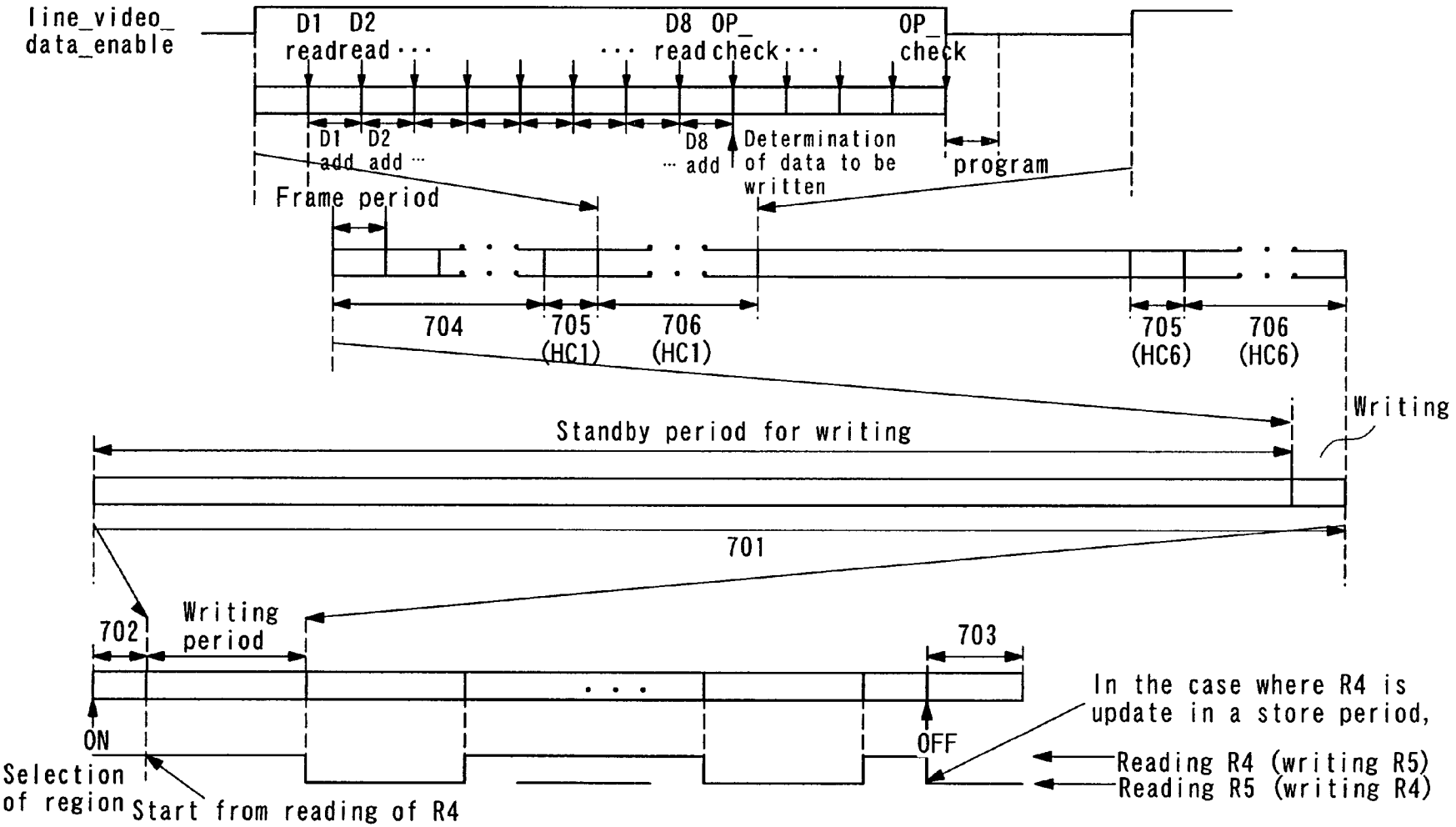
FIG. 7 is a timing chart showing an access timing for writing to and reading from a nonvolatile storage portion in the control circuit shown in FIG. 4.

FIG. 7 is a timing chart showing the reading and writing timing of the nonvolatile storage portion 407. Writing of the upper bit (UB) of accumulated time data is performed once in the shortest time between the occurrence of a half carry (HC) by the adding operation and the occurrence of the next half carry (shortest period of generating a half carry 701 shown in FIG. 7). For example, it is assumed that the number of bits for displaying a gray scale by the time gray scale display method is 6, the lower bit of the accumulated time data has 16 bits, and video data is sampled once per second. In this case, at most $2^6$=64 gray scale levels (=time) are accumulated per second, and thus the shortest time of generating a half carry is $2^{16}$/64=1024 seconds (=about 17 minutes). The writing area and the reading area are switched between the regions R4 and R5 every time writing is performed in accordance with the rising and falling of an area selection signal. FIG. 7 shows the case where data is read from the region R4 and data is written to the region R5 when an area selection signal rises, and the regions R4 and R5 are inverted when the area selection signal falls. Note that a recall period 702 and a store period 703 shown in FIG. 9 respectively shows a timing of transferring a degradation coefficient and the lower bit of the accumulated time data to the volatile storing means when the power is turned on and a timing of transferring them to the nonvolatile storage portion 407 when the power is turned off. These operations are described below.

The upper part of FIG. 7 shows in detail the writing operation of the upper bit of the accumulated time data, which is performed once in the shortest time of generating a half carry. FIG. 7 shows an example where K=6 is satisfied and a half carry is added to 8 upper bits of the accumulated time data during a reception period of one row, though any number of upper bits of the accumulated time data may be added to the half carry during a reception period of one row. An enable signal of receiving video data of one row is denoted as line_video_data_enable. When the signal rises or falls to be an enable state (when it rises herein), video data of one row can be read. D1read to D8read show reading operations of the upper bit of the accumulated time data to be added, D1add to D8add show adding operations of a half carry and the upper bit of the accumulated time data read by the second adder 412, and program shows an input period of a program command. In writing, first, data of the region R4 or R5 to which data is written is erased (704). In the next frame period, a half carry HC1 of the first area (k=1) of six areas is cached (705) in the half carry temporary storage portion 420. In the next frame period and thereafter, the upper bit of the accumulated time data is read from either the region R4 or R5 from which data is read, and added to a corresponding cached half carry (HC2 to HC6). The addition result is stored, and when the line_video_data_enable falls, a program command is inputted to the nonvolatile storage portion 407 to write the addition result (706). Data corresponding to the half carry of the volatile storage portion 403 is reset to "0" immediately after the half carry is read from the volatile storage portion 403, unless a new half carry is generated. In the aforementioned operation, half carries of 1/K pixels are cached in the half carry temporary storage portion 420 every frame period, though a frame period is not necessarily used as unit. During an automatic program (writing), an automatic operation is checked and the next writing operation starts when the automatic operation is completed. If the automatic operation is not performed normally and timeout occurs, it is possible to input a reset command to write the same data again. According to this, malfunction due to noise can be corrected and reliability can be improved. In addition, the program command is not necessarily inputted to the nonvolatile storage portion 407 after the line_video_data_enable falls as shown in FIG. 7, though it may be inputted at a different timing if possible.

(5) Video Data Correction Portion

The control circuit shown in FIG. 4 includes, as a video data correcting portion of the video data correction circuit, a degradation coefficient region RC of the nonvolatile storage portion 407, which stores a degradation coefficient in advance, a degradation coefficient storage portion 421 for caching a degradation coefficient transferred (recalled) from the degradation coefficient region RC when the power is turned on, a first read degradation coefficient storage portion 418A for temporarily storing a corresponding degradation coefficient read from the degradation coefficient storage portion 421 based on the upper bit of the accumulated time data read from the region R4 or R5 of the nonvolatile storage portion 407 through a selector SEL3, and a second read degradation coefficient storage portion 418B that periodically receives a degradation coefficient from the first read degradation coefficient storage portion 418A. The degradation coefficient stored in the second degradation coefficient storage portion 418B is supplied to the correction portion 422 in the format converting portion 414 of the video data writing portion VW to be used for degradation correction of video data.

Figure 8:
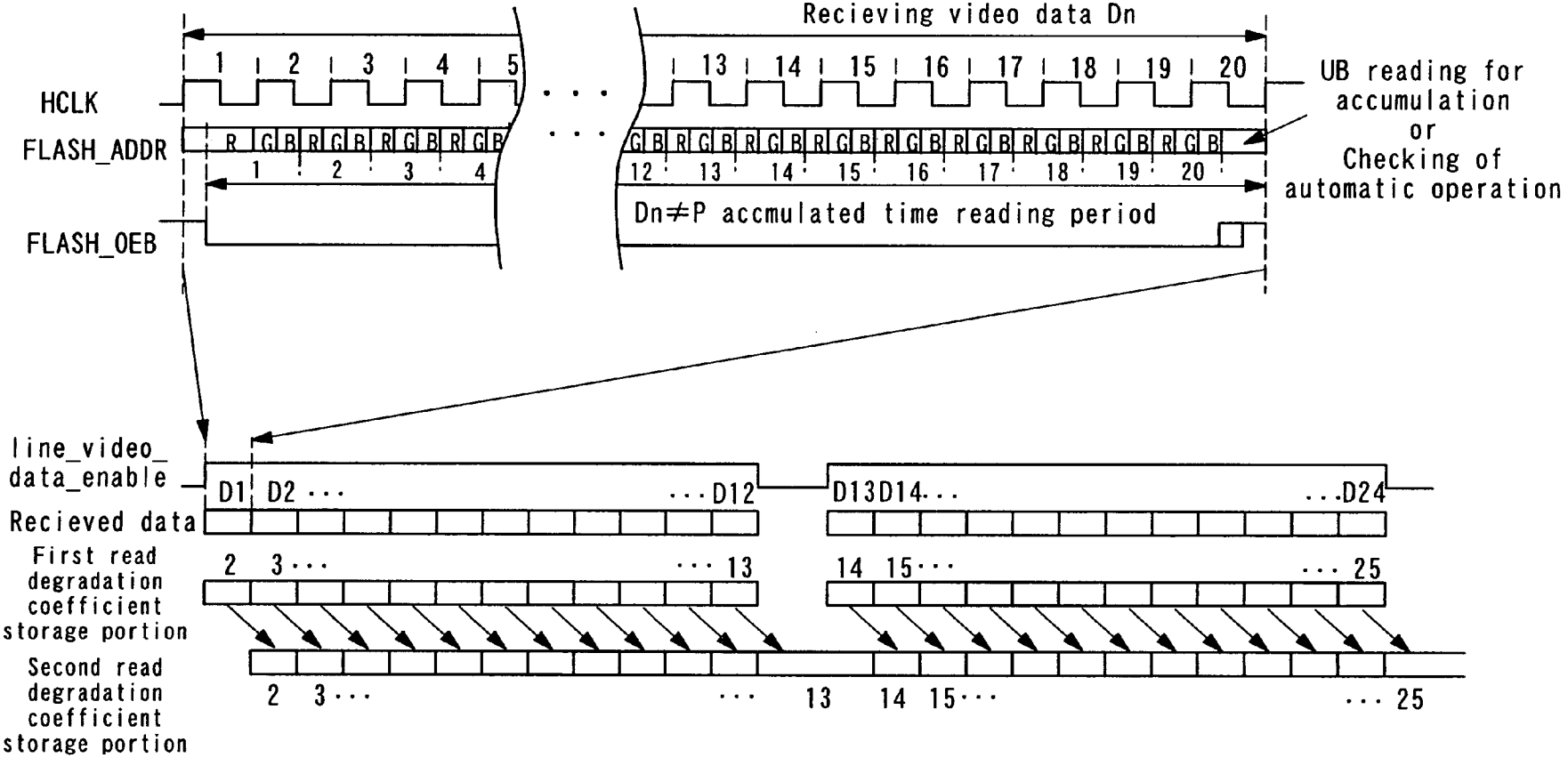
FIG. 8 is a timing chart showing a relation between a reception period, and reading of the upper bit of accumulated time data from the nonvolatile storage portion in the control circuit shown in FIG. 4 and receiving of a cached degradation coefficient.

FIG. 8 is a timing chart showing the relation between a reception period, and reading of the upper bit of accumulated time data from the nonvolatile storage portion 407 and receiving of a cached degradation coefficient. HCLK denotes a hardware clock signal (one period is one reception period), and FLASH_ADDR denotes an address for storing the upper bit of the accumulated time data of a specific light emitting element for R, G or B, which is specified by an address generating circuit of the nonvolatile storage portion. FLASH_OEB denotes an enable signal for reading the nonvolatile storage portion. When the signal rises or falls to be an enable state (when it falls herein), video data can be read. An enable signal of receiving video data of one row is denoted as line_video_data_enable as shown in FIG. 7. When the signal rises to be an enable state, video data of one row can be received.

The reading of the upper bit of the accumulated time data for correction may be performed in synchronism with a reception period if possible. In this embodiment mode, as shown in FIG. 8, a degradation coefficient of video data for n reception periods (n=30 in FIG. 5), which is corrected by the format converting portion 414 at a time, is stored in the first read degradation coefficient storage portion 418A, and transferred to the second read degradation coefficient storage portion 418B every j (j is a positive integer) reception periods. Then, video data is corrected in synchronism with a reception period by using the degradation coefficient stored in the second read degradation coefficient storage portion 418B. By using the first read degradation coefficient storage portion 418A and the second read degradation coefficient storage portion 418B, the upper bit of the accumulated time data for selecting a degradation coefficient can be read in the shortest time. Accordingly, a time margin can be obtained for the reading of the upper bit of the accumulated time data from the nonvolatile storage portion 407, the program operation check, and the program command input, which are described in (4) accumulated time data upper bit storage portion.

In FIG. 8, a degradation coefficient is stored in the first read degradation coefficient storage portion 418A every 20 reception periods (j=20), thereby reading access to the nonvolatile storage portion 407 can be performed at least once for every 20 reception periods. This access period is used for the reading of the upper bit of the accumulated time data to be added to a half carry, or the checking of the automatic writing operation of the nonvolatile storage portion 407, which is described in (4) accumulated time data upper bit storage portion with reference to FIG. 7.

(6) Accumulated Time Data Backup Portion

The control circuit shown in FIG. 4 uses the regions R4 and R5 of the nonvolatile storage portion 407 as a backup portion of the accumulated time data in the video data correction circuit. That is to say, when the power is turned off, one of the regions R4 and R5, to which the upper bit of the accumulated time data is written, is used for creating a backup of the upper bit of the accumulated time data. Meanwhile, the other region is used for creating a backup of the lower bit of the accumulated time data, and the lower bit of the accumulated time data stored in the region R3 of the volatile memory is transferred (stored) to the other region immediately before the power is turned off. When the power is turned on, the lower bit of the accumulated time data stored in the nonvolatile storage portion 407 is transferred (recalled) to the region R3 of the volatile storage portion 403.

More specifically, as shown in the access timing chart of the nonvolatile storage portion in FIG. 7, data of either the region R4 or R5 (R4 in FIG. 7) to which the upper bit of the accumulated time data is written is updated during a storage period immediately before the power is turned off and power supply is stopped. The lower bit of the accumulated time data is written from the nonvolatile storage portion 407 to the other region (R5 in FIG. 7) whose data is not updated. During a recall period immediately after the power is turned on, operation starts using as the reading region the region (R4 in FIG. 7) to which the upper bit of the accumulated time data is written. If the degradation coefficient storage portion 421 for caching a degradation coefficient is provided as described in (5) video data correction portion, the degradation coefficient stored in the region RC of the nonvolatile storage portion 407 is recalled to the degradation coefficient storage portion 421 in this recall period.

According to the aforementioned operation of each portion (1) to (6), the format of a received video signal can be converted to be able to perform a gray scale display in a display device while corrected video data can be supplied to a display panel, by using a simplified configuration where only two main storing means are used and the number of connection pins is minimized.

If gray scale display is performed by controlling the luminance of an EL element similarly to Embodiment Modes 1 to 3, correcting data is made so as to determine the degradation rate of the light emitting element by detecting the lighting time and the lighting intensity. In such a case, data on the accumulated lighting time and lighting intensity is stored in the volatile storage portion 403 and the nonvolatile storage portion 407, and a degradation coefficient based on the accumulated usage obtained by taking into consideration the accumulated lighting time and lighting intensity is stored in the nonvolatile storage portion 407 in advance.

An element used for the storing means such as the volatile storage portion 403 and the nonvolatile storage portion 407 may be a static memory (SRAM), a dynamic memory (DRAM), a ferroelectric memory (FeRAM), an EEPROM, a flash memory, or the like. Instead, any memory element that is used generally can be employed.

The video data reading portion VR of (2) may be integrated as one integrated circuit. When each element constituting the reading means is integrated as one integrated circuit, miniaturization of circuit is facilitated, the circuit configuration is simplified, reliability is improved, and reduction in production cost can be achieved. Each element constituting the video data reading portion VR may be integrated as one integrated circuit, or may be provided separately.

The accumulated time data is thus divided into the upper bit and the lower bit, and the lower bit is stored in an unused address area of the storing means such as a video memory used in the display control circuit while the upper bit is stored in the nonvolatile storing means. As a result, the video data correction circuit can be integrated with the control circuit of a display device, and a volatile memory for accumulating time data is no longer required to be provided separately. In addition, the display control circuit and the video data correction circuit can be incorporated in the same device by using only one memory element for the volatile storage portion used as a main video data storage portion of the control circuit. Therefore, simplified circuit configuration, reduction in the number of pins to be mounted, and a further reduced mounting area can be achieved, which results in miniaturization and reduction in the production cost of the product, and improved reliability of the circuit. Further, since the upper bit of the accumulated time data is stored in the nonvolatile storing means, the necessary time and power consumption of the backup operation when the power is off can be reduced to half or less.

Embodiment 1

The invention can be applied to various electronic apparatuses each including a light emitting display device, such as a desktop, floor-standing or wall-mounted type display, a video camera, a digital camera, a goggle type display (head mounted display), a navigation system, a sound reproducing device (car audio, audio component set and the like), a computer, a game machine, a portable information terminal (mobile computer, mobile phone, portable game machine, electronic book and the like), and an image reproducing device provided with a recording medium (specifically, device reproducing a video image or a still image recorded in a recording medium such as a digital versatile disc (DVD), and having a display portion for displaying the reproduced image). Specific examples of such electronic apparatuses are shown in FIGS. 9A to 9H.

Figure 9A:
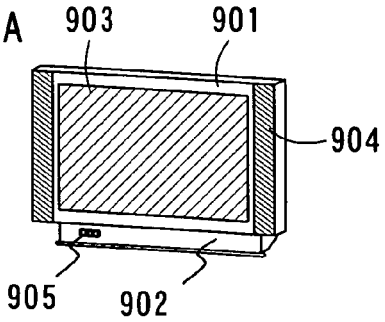
FIGS. 9A to 9H are views showing electronic apparatuses using the invention.

FIG. 9A illustrates a desktop, floor-standing or wall-mounted type display, which includes a housing 901, a supporting base 902, a display portion 903, a speaker portion 904, a video input terminal 905 and the like. The invention can be applied to a peripheral circuit (video data correction circuit or control circuit) of the display portion 903, thereby an image can be displayed normally without luminance variations even when an element in a screen of the light emitting device degrades. Further, miniaturization of the display portion can be achieved as well as miniaturization and reduction in production cost of the entire device.

Figure 9B:
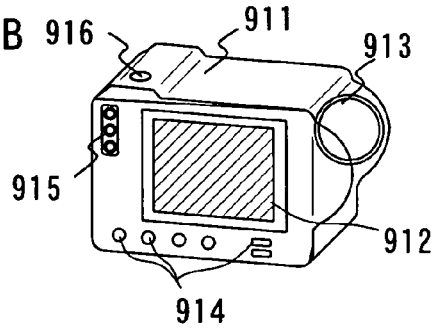

FIG. 9B illustrates a digital camera including a main body 911, a display portion 912, an image receiving portion 913, operating keys 914, an external connection port 915, a shutter 916 and the like. The invention can be applied to a peripheral circuit (video data correction circuit or control circuit) of the display portion 912, thereby an image can be displayed normally without luminance variations even when an element in a screen of the light emitting device degrades. Further, miniaturization of the display portion can be achieved as well as miniaturization and reduction in production cost of the entire device.

Figure 9C:
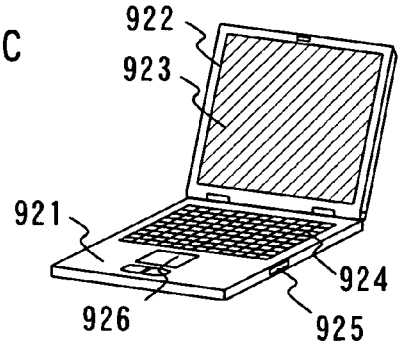

FIG. 9C illustrates a computer including a main body 921, a housing 922, a display portion 923, a keyboard 924, an external connection port 925, a pointing mouse 926 and the like. The invention can be applied to a peripheral circuit (video data correction circuit or control circuit) of the display portion 923, thereby an image can be displayed normally without luminance variations even when an element in a screen of the light emitting device degrades. Further, miniaturization of the display portion can be achieved as well as miniaturization and reduction in production cost of the entire device. Note that the computer includes what is called a laptop computer that incorporates a central processing unit (CPU) and a recording medium, and what is called a desktop computer that does not incorporate them.

Figure 9D:
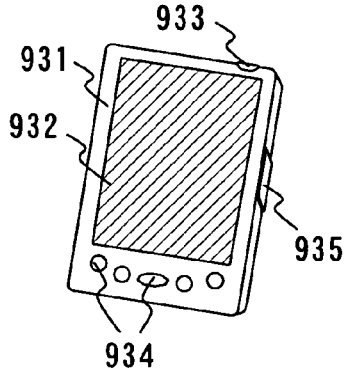

FIG. 9D illustrates a mobile computer including a main body 931, a display portion 932, a switch 933, operating keys 934, an IR port 935 and the like. The invention can be applied to a peripheral circuit (video data correction circuit or control circuit) of the display portion 932, thereby an image can be displayed normally without luminance variations even when an element in a screen of the light emitting device degrades. Further, miniaturization of the display portion can be achieved as well as miniaturization and reduction in production cost of the entire device.

Figure 9E:
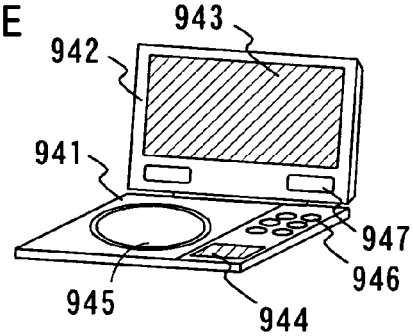

FIG. 9E illustrates a portable image reproducing device provided with a recording medium (specifically, DVD reproducing device), which includes a main body 941, a housing 942, a first display portion 943, a second display portion 944, a recording medium (such as DVD) reading portion 945, an operating key 946, a speaker portion 947 and the like. The first display portion 943 mainly displays image data while the second display portion 944 mainly displays text data. The invention can be applied to peripheral circuits (video data control circuits or control circuits) of the first and second display portions 943 and 944, thereby an image can be displayed normally without luminance variations even when an element in a screen of the light emitting device degrades. Further, miniaturization of the display portion can be achieved as well as miniaturization and reduction in production cost of the entire device. Note that the image reproducing device provided with a recording medium includes a home game machine and the like.

Figure 9F:
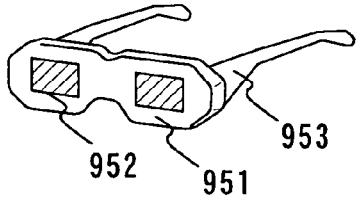

FIG. 9F illustrates a goggle type display device (head mounted display) including a main body 951, a display portion 952 and an arm portion 953. The invention can be applied to a peripheral circuit (video data correction circuit or control circuit) of the display portion 952, thereby an image can be displayed normally without luminance variations even when an element in a screen of the light emitting device degrades. Further, miniaturization of the display portion can be achieved as well as miniaturization and reduction in production cost of the entire device.

Figure 9G:
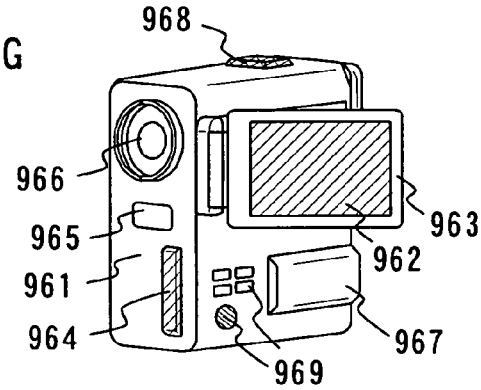

FIG. 9G illustrates a video camera including a main body 961, a display portion 962, a housing 963, an external connection port 964, a remote control receiving portion 965, an image receiving portion 966, a battery 967, a sound input portion 968, operating keys 969 and the like. The invention can be applied to a peripheral circuit (video data correction circuit or control circuit) of the display portion 962, thereby an image can be displayed normally without luminance variations even when an element in a screen of the light emitting device degrades. Further, miniaturization of the display portion can be achieved as well as miniaturization and reduction in production cost of the entire device.

Figure 9H:
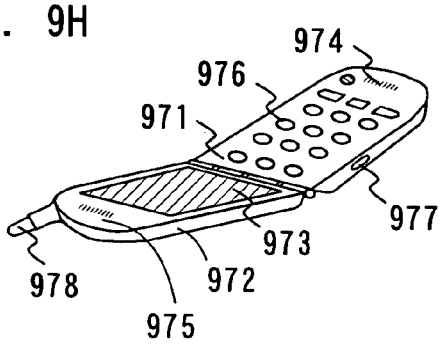
Figure 10:
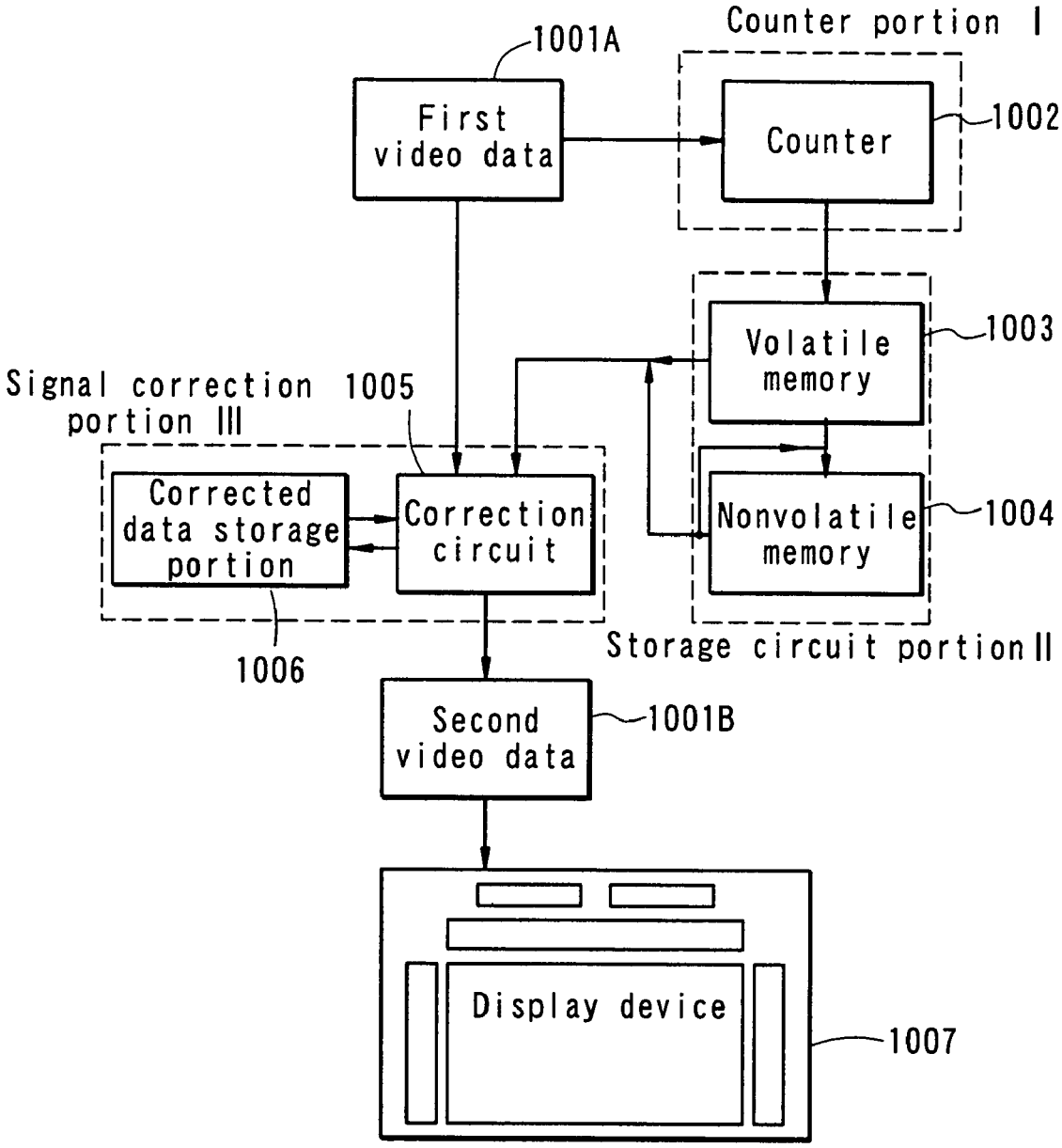
FIG. 10 is a block diagram showing a video data correction circuit of the related art.

FIG. 9H illustrates a mobile phone including a main body 971, a housing 972, a display portion 973, a sound input portion 974, a sound output portion 975, an operating key 976, an external connection port 977, an antenna 978 and the like. The invention can be applied to a peripheral circuit (video data correction circuit or control circuit) of the display portion 973, thereby an image can be displayed normally without luminance variations even when an element in a screen of the light emitting device degrades. Further, miniaturization of the display portion can be achieved as well as miniaturization and reduction in production cost of the entire device.

The display device used in such electronic apparatuses may be constituted by using not only a glass substrate but also a heat resistant plastic substrate, in which case further reduction in weight can be achieved.

Although the invention has been fully described by way of Embodiment Modes and Embodiment with reference to the accompanying drawings, it is to be understood that various changes and modifications will be apparent to those skilled in the art. Therefore, unless otherwise such changes and modifications depart from the scope of the invention hereinafter defined, they should be construed as being included therein. For example, this embodiment can be implemented in combination with any of the aforementioned embodiment modes.

This application is based on Japanese Patent Application serial No. 2004-206882 filed in Japan Patent Office on Jul. 14, 2004, the entire contents of which are hereby incorporated by reference.

What is claimed is:

1. A display device comprising:

a detector for detecting usage data of each pixel by sampling video data supplied to a display device having a pixel using a light emitting element;

a first storage portion for storing a lower bit of accumulated usage data of each pixel;

a second storage portion for storing an upper bit of accumulated usage data of each pixel;

a first adder for adding the usage data of each pixel detected by the detector to the lower accumulated usage data of each pixel stored in the first storage portion, thereby writing an addition result to the first storage portion as a lower bit of new accumulated usage data;

a second adder for adding a carry generated by the addition result of the first adder to the upper bit of the accumulated usage data of each pixel stored in the second storage portion, thereby writing an addition result to the nonvolatile storage portion as an upper bit of new accumulated usage data; and a corrector for generating corrected video data by correcting the video data based on the accumulated usage data stored in at least one of the first storage portion and the second storage portion.

2. The display device according to claim 1, wherein the accumulated usage data of each pixel is accumulated usage data based on at least one of accumulated lighting time of each pixel and lighting intensity of each pixel.

3. A display device comprising:

a detector for detecting usage data of each pixel by sampling video data supplied to a display device having a pixel using a light emitting element;

a first volatile storage portion for storing a lower bit of accumulated usage data of each pixel;

a second volatile storage portion for storing an upper bit of accumulated usage data of each pixel;

a first adder for adding the usage data of each pixel detected by the detector to the lower bit of accumulated usage data of each pixel stored in the first volatile storage portion thereby writing an addition result to the first volatile storage portion as a lower bit of new accumulated usage data;

a second adder for adding a carry generated by the addition result of the first adder to the upper bit of the accumulated usage data of each pixel stored in the second volatile storage portion, thereby writing an addition result to the second volatile storage portion as an upper bit of new accumulated usage data; and a corrector for generating corrected video data by correcting the video data based on the accumulated usage data stored in at least one of the first volatile storage portion and the second volatile storage portion.

4. The display device according to claim 3, wherein the accumulated usage data of each pixel is accumulated usage data based on at least one of accumulated lighting time of each pixel and lighting intensity of each pixel.

5. A display device comprising:

a detector for detecting usage data of each pixel by sampling video data supplied to a display device having a pixel using a light emitting element;

a first volatile storage portion for storing a lower bit of accumulated usage data of each pixel;

a second volatile storage portion for storing an upper bit of accumulated usage data of each pixel;

a first adder for adding the usage data of each pixel detected by the detector to the lower bit of accumulated usage data of each pixel stored in the first volatile storage portion thereby writing an addition result to the first volatile storage portion as a lower bit of new accumulated usage data;

a second adder for adding a carry generated by the addition result of the first adder to the upper bit of the accumulated usage data of each pixel stored in the second volatile storage portion, thereby writing an addition result to the second volatile storage portion as an upper bit of new accumulated usage data; and a corrector for generating corrected video data by correcting the video data based on the accumulated usage data stored in at least one of the first volatile storage portion and the second volatile storage portion, wherein the first volatile storage portion is an unused address area of a video memory used in a display control circuit.

6. The display device according to claim 5, wherein the accumulated usage data of each pixel is accumulated usage data based on at least one of accumulated lighting time of each pixel and lighting intensity of each pixel.

7. A display device comprising:

a detector for detecting usage data of each pixel by sampling video data supplied to a display device having a pixel using a light emitting element;

a volatile storage portion for storing a lower bit of accumulated usage data of each pixel;

a nonvolatile storage portion for storing an upper bit of accumulated usage data of each pixel;

a first adder for adding the usage data of each pixel detected by the detector to the lower bit of the accumulated usage data of each pixel stored in the volatile storage portion, thereby writing an addition result to the volatile storage portion as a lower bit of new accumulated usage data;

a second adder for adding a carry generated by the addition result of the first adder to the upper bit of the accumulated usage data of each pixel stored in the nonvolatile storage portion, thereby writing an addition result to the nonvolatile storage portion as an upper bit of new accumulated usage data; and a corrector for generating corrected video data by correcting the video data based on the accumulated usage data stored in at least one of the volatile storage portion and the nonvolatile storage portion wherein the first volatile storage portion is an unused address area of a video memory used in a display control circuit.

8. The display device according to claim 7, wherein the accumulated usage data of each pixel is accumulated usage data based on at least one of accumulated lighting time of each pixel and lighting intensity of each pixel.

9. A display device comprising:

a detector for detecting usage data of each pixel by sampling video data supplied to a display device having a pixel using a light emitting element;

a volatile storage portion for storing a lower bit of accumulated usage data of each pixel;

a nonvolatile storage portion for storing an upper bit of accumulated usage data of each pixel;

a first adder for adding usage data of each pixel detected by the detector to the lower bit of accumulated usage data of each pixel stored in the volatile storage portion, thereby writing an addition result to the volatile storage portion as a lower bit of new accumulated usage data;

a second adder for adding a carry generated by the addition result of the first adder to the upper bit of the accumulated usage data of each pixel stored in the nonvolatile storage portion, thereby writing an addition result to the nonvolatile storage portion as an upper bit of new accumulated usage data; and a corrector for generating corrected video data by correcting the video data based on the accumulated usage data stored in the nonvolatile storage portion.

10. The display device according to claim 9, wherein the accumulated usage data of each pixel is accumulated usage data based on at least one of accumulated lighting time of each pixel and lighting intensity of each pixel.

11. A display device comprising:

a detector for detecting usage data of each pixel by sampling video data supplied to a display device having a pixel using a light emitting element;

a volatile storage portion for storing a lower bit of accumulated usage data of each pixel;

a nonvolatile storage portion for storing an upper bit of accumulated usage data of each pixel;

a first adder for adding the usage data of each pixel detected by the detector to the lower bit of the accumulated usage data of each pixel stored in the volatile storage portion, thereby writing an addition result to the volatile storage portion as a lower bit of new accumulated usage data;

a second adder for adding a carry generated by the addition result of the first adder to the upper bit of the accumulated usage data of each pixel stored in the nonvolatile storage portion, thereby writing an addition result to the nonvolatile storage portion as an upper bit of new accumulated usage data; and a corrector for generating corrected video data by correcting the video data based on the accumulated usage data stored in at least one of the volatile storage portion and the nonvolatile storage portion.

12. The display device according to claim 11, wherein the accumulated usage data of each pixel is accumulated usage data based on at least one of accumulated lighting time of each pixel and lighting intensity of each pixel.

13. A display device comprising:

a detector for detecting usage data of each pixel by sampling video data supplied to a display device having a pixel using a light emitting element;

a volatile storage portion for storing a lower bit of accumulated usage data of each pixel;

a nonvolatile storage portion for storing an upper bit of accumulated usage data of each pixel;

a first adder for adding the usage data of each pixel detected by the detector to the lower bit of the accumulated usage data of each pixel stored in the volatile storage portion, thereby writing an addition result to the volatile storage portion as a lower bit of new accumulated usage data;

a second adder for adding a carry generated by the addition result of the first adder to the upper bit of the accumulated usage data of each pixel stored in the nonvolatile storage portion, thereby writing an addition result to the nonvolatile storage portion as an upper bit of new accumulated usage data; and a corrector for generating corrected video data by correcting the video data based on the accumulated usage data stored in the nonvolatile storage portion, wherein the corrector comprises a multiplier for multiplying the video data by a degradation coefficient selected from a plurality of degradation coefficients based on the upper bit of the accumulated usage data.

14. The display device according to claim 13, wherein the accumulated usage data of each pixel is accumulated usage data based on at least one of accumulated lighting time of each pixel and lighting intensity of each pixel.

15. A display device comprising:

a first volatile storage portion having a first area for storing video data supplied to a display device having a pixel using a light emitting element and a second area for storing a first portion of accumulated usage data of each pixel;

a second volatile storage portion having a third area for storing video data supplied to a display device having a pixel using a light emitting element;

a nonvolatile storage portion for storing a second portion of accumulated usage data of each pixel;

a reader for reading the video data from either the first area or the third area to be supplied to a display panel, wherein a storage portion for reading the video data is switched between the first area and the third area every time one or more images are displayed;

a detector for detecting usage data of each pixel by sampling the video data;

a first adder for adding the usage data of each pixel detected by the detector to the first portion of the accumulated usage data of each pixel stored in the second area, thereby writing an addition result to the second area as a first portion of new accumulated usage data;

a second adder for adding the second portion of the accumulated usage data of each pixel stored in the nonvolatile storage portion, thereby writing an addition result to the nonvolatile storage portion as a second portion of new accumulated usage data; and a writer for converting a supplied video signal into the video data capable of performing a gray scale display in a display device and correcting the video data based on the accumulated usage data stored in at least one of the second area and the nonvolatile storage portion, thereby writing the corrected video data to either the first area or the third area, from which video data is not read.

16. The display device, according to claim 15, wherein the accumulated usage data of each pixel is accumulated usage data based on at least one of accumulated lighting time of each pixel and lighting intensity of each pixel.

17. The display device, according to claim 15, wherein the first data portion is a lower bit of the accumulated usage data, while the second data portion is an upper bit of the accumulated usage data.

18. A display device comprising:

a volatile storage portion having a first area and a second area each storing video data supplied to a display device having a pixel using a light emitting element and a third area for storing a first portion of accumulated usage data of each pixel;

a nonvolatile storage portion for storing a second portion bit of accumulated usage data of each pixel;

a reader for reading the video data from either the first area or the second area to be supplied to a display panel, wherein an area for reading the video data is switched between the first area and the second area every time one or more images are displayed, and a predetermined amount of video data corresponding to a display timing of the display panel is sequentially read from either the first area or the second area during a plurality of clock periods;

a detector for detecting usage data of each pixel by sampling the video data;

a first adder for adding the usage data of each pixel detected by the detector to the first portion of the accumulated usage data of each pixel stored in the third area, thereby writing an addition result to the third area as a first portion of new accumulated usage data;

a second adder for adding the second portion of the accumulated usage data of each pixel stored in the nonvolatile storage portion, thereby writing an addition result to the nonvolatile storage portion as a second portion of new accumulated usage data; and a corrector for converting a supplied video signal into the video data capable of performing a gray scale display in a display device and correcting the video data based on the accumulated usage data stored in at least one of the third area and the nonvolatile storage portion; and a writer for writing the corrected video data to either the first area or the second area, from which video data is not read.

19. The display device, according to claim 18, wherein the accumulated usage data of each pixel is accumulated usage data based on at least one of accumulated lighting time of each pixel and lighting intensity of each pixel.

20. The display device, according to claim 18, wherein the first data portion is a lower bit of the accumulated usage data, while the second data portion is an upper bit of the accumulated usage data.

* * * * *

UNITED STATES PATENT AND TRADEMARK OFFICE

CERTIFICATE OF CORRECTION

PATENT NO. : 7,663,576 B2
APPLICATION NO. : 11/176475
DATED : February 16, 2010
INVENTOR(S) : Tadafumi Ozaki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1257 days.

Signed and Sealed this

Twenty-eighth Day of December, 2010

David J. Kappos

David J. Kappos
*Director of the United States Patent and Trademark Office*